US012203405B2

(12) United States Patent
Misumi et al.

(10) Patent No.: US 12,203,405 B2
(45) Date of Patent: Jan. 21, 2025

(54) ENGINE SYSTEM

(71) Applicant: Mazda Motor Corporation, Aki-gun (JP)

(72) Inventors: Haruki Misumi, Aki-gun (JP); Takuma Yamagaki, Aki-gun (JP)

(73) Assignee: Mazda Motor Corporation, Hiroshima (JP)

( * ) Notice: Subject to any disclaimer, the term of this patent is extended or adjusted under 35 U.S.C. 154(b) by 310 days.

(21) Appl. No.: 17/720,569

(22) Filed: Apr. 14, 2022

(65) Prior Publication Data

US 2022/0235692 A1 Jul. 28, 2022
US 2023/0417171 A9 Dec. 28, 2023

(30) Foreign Application Priority Data

May 13, 2021 (JP) ..... 2021-081791

(51) Int. Cl.
*F01P 7/16* (2006.01)
*F01P 3/02* (2006.01)
*F01P 7/14* (2006.01)

(52) U.S. Cl.
CPC ..... *F01P 7/16* (2013.01); *F01P 3/02* (2013.01); *F01P 2003/021* (2013.01); *F01P 2007/146* (2013.01)

(58) Field of Classification Search
CPC .... F01P 3/02; F01P 7/164; F01P 7/165; F01P 2003/027; F02D 1/025; F02D 2001/0075
See application file for complete search history.

(56) References Cited

U.S. PATENT DOCUMENTS 10,161,501 B2 * 12/2018 Gonze ..... F16K 31/025
2007/0006571 A1 * 1/2007 Vetrovec ..... F02M 25/12 60/281
2008/0201034 A1 * 8/2008 Eiraku ..... F02D 41/221 701/104
2012/0137993 A1 * 6/2012 Kim ..... F01P 7/165 123/41.11
2013/0305708 A1 * 11/2013 Zahdeh ..... F01P 3/20 60/599

(Continued)

FOREIGN PATENT DOCUMENTS

JP 2016128652 A 7/2016

*Primary Examiner* — Kurt Philip Liethen
(74) *Attorney, Agent, or Firm* — Alleman Hall & Tuttle LLP

(57) ABSTRACT

An engine system is provided, including an engine, a circulation system that circulates coolant through a water jacket, and a controller. The circulation system includes a radiator passage including a heat exchanger, a bypass passage, a flow rate control device, and a thermally-actuated valve. The engine has a spark plug that forcibly ignites an air-fuel mixture. The engine switches between a first combustion in which the air-fuel mixture combusts without the forcible ignition, and a second combustion in which the air-fuel mixture combusts by the forcible ignition. The controller is electrically connected to the flow rate control device, and when the engine performs the first combustion, the controller controls the flow rate control device to adjust the flow rate of the coolant flowing through the water jacket according to the engine load, by closing the radiator passage and adjusting the flow rate of the coolant flowing through the bypass passage.

20 Claims, 10 Drawing Sheets

(56) References Cited

U.S. PATENT DOCUMENTS

| | | | | |
|---|---|---|---|---|
| 2016/0146092 | A1* | 5/2016 | Lee | F01P 7/16<br>123/41.1 |
| 2017/0159546 | A1* | 6/2017 | Gonze | F01P 5/10 |
| 2017/0321594 | A1* | 11/2017 | Gonze | F01P 7/165 |
| 2017/0356327 | A1* | 12/2017 | Gonze | F01P 7/164 |
| 2018/0320617 | A1* | 11/2018 | Ahmed | F01N 3/043 |
| 2018/0371982 | A1* | 12/2018 | Bilancia | F02F 1/40 |
| 2024/0066942 | A1* | 2/2024 | Sommers | B60P 3/20 |

* cited by examiner

ENGINE SYSTEM

TECHNICAL FIELD

The disclosed technology relates to an engine system.

BACKGROUND OF THE DISCLOSURE

JP2016-128652A discloses a cooling device for an engine. This cooling device has a radiator path which circulates coolant between the engine and a radiator, and a radiator bypass path which bypasses the radiator and circulates the coolant. In the radiator bypass path, an ATF warmer which warms a heater core of an air-conditioner and lubrication oil of an automatic transmission is disposed.

The cooling device has a rotary flow rate control valve. The rotary flow rate control valve opens and closes the radiator path and the radiator bypass path according to a rotational position of a rotary valve body. Further, the rotary flow rate control valve has a radiator path connecting passage and a thermostat valve allocation passage. The radiator path connecting passage is connected to the radiator path. A thermostat valve is provided to the thermostat valve allocation passage. When opening the thermostat valve, the coolant flows into the radiator path from the thermostat valve allocation passage.

When the engine is warm with the coolant at a temperature above a given temperature, the rotary flow rate control valve rotates the rotary valve body to a rotational position where the coolant flows into each of the radiator bypass path and the thermostat valve allocation passage. Since the thermostat valve opens while the engine is warm, the coolant flows into the radiator path from the thermostat valve allocation passage.

When the temperature of the coolant further increases, the rotary flow rate control valve rotates the rotary valve body to a rotational position where the coolant flows to all of the radiator bypass path, the thermostat valve allocation passage, and the radiator path connecting passage. Further, the rotational position of the rotary valve body is adjusted so that a flow rate of the coolant to the radiator path increases as a temperature of the coolant, an engine load, and/or an engine speed increase.

The combustion chamber becomes high in the temperature after the engine has been fully warmed up. In order to cool the combustion chamber, a passage through which the coolant cooled by the radiator flows (a so-called "water jacket") is provided to a part around the combustion chamber, such as a cylinder bore and a cylinder head, which constitute the engine body, which is also provided to the cooling device disclosed in JP2016-128652A.

Meanwhile, in the engine combustion control, the temperature inside the combustion chamber (in-cylinder temperature) is one of the important factors. The in-cylinder temperature requires a more precise control as the combustion control becomes more advanced. For example, in order to stably control compression ignition combustion, it is necessary to accurately control the in-cylinder temperature at a temperature higher than that of spark ignition combustion. In addition, since the heat generated inside the combustion chamber varies according to the engine load, the in-cylinder temperature also varies.

In the in-cylinder temperature control, a wall temperature of the combustion chamber is one of the important factors. It is demanded that the wall temperature of the combustion chamber is adjusted with good response to the change in the engine load.

The cooling device disclosed in JP2016-128652A lowers the temperature of the coolant by increasing the flow rate of the coolant which flows through the radiator path, when the temperature of the coolant becomes high. When the temperature of the coolant changes, the heat exchanging quantity between the coolant and the combustion chamber changes. If the heat exchanging quantity is changed according to the heat generated inside the combustion chamber, the wall temperature of the combustion chamber can be adjusted.

However, since the calorific capacity of the coolant is large, it requires a long period of time to change the temperature of the coolant. It is difficult for the temperature adjustment of the coolant to adjust the wall temperature of the combustion chamber with good response to the change in the engine load.

SUMMARY OF THE DISCLOSURE

The technology disclosed herein adjusts a wall temperature of a combustion chamber with high response according to a load of an engine.

The present inventers have completed the technology disclosed herein by paying attention to the adjustment of the wall temperature of the combustion chamber by changing a flow rate of coolant which flows through a water jacket to change a heat transfer coefficient between the coolant and the combustion chamber, without changing a temperature of the coolant.

According to one aspect of the present disclosure, an engine system is provided, which includes an engine having a water jacket formed around a combustion chamber, a circulation system that is attached to the engine and circulates coolant through the water jacket, and a controller configured to control the circulation system according to an operating state of the engine. The circulation system includes a radiator passage including a heat exchanger, a bypass passage bypassing the heat exchanger, a flow rate control device that adjusts a flow rate of coolant flowing through the water jacket by adjusting a flow rate of coolant flowing through each of the radiator passage and the bypass passage, and a thermally-actuated valve that is connected to the radiator passage and opens to allow the coolant to pass through the heat exchanger. The engine has a spark plug that forcibly ignites an air-fuel mixture, and switches between a first combustion in which the air-fuel mixture combusts without the forcible ignition of the spark plug, and a second combustion in which the air-fuel mixture combusts by the forcible ignition of the spark plug. The controller is electrically connected to the flow rate control device. When the engine performs the first combustion, the controller controls the flow rate control device to adjust the flow rate of the coolant flowing through the water jacket according to a load of the engine, by closing the radiator passage and adjusting the flow rate of the coolant flowing through the bypass passage.

According to this configuration, the coolant passing through the water jacket of the engine exchanges heat with the combustion chamber. The coolant circulates through the water jacket by the circulation system.

The circulation system includes the thermally-actuated valve which opens when the coolant reaches a given temperature. When the thermally-actuated valve opens, part of the coolant passes through the heat exchanger, and thus, a coolant temperature decreases. By the thermally-actuated valve, the coolant temperature is maintained at a specific temperature corresponding to a valve-opening temperature of the thermally-actuated valve.

When the engine performs the first combustion, the flow rate control device closes the radiator passage, and thus the coolant flows through the bypass passage. Further, the flow rate control device adjusts the flow rate of the coolant. Therefore, the flow rate of the coolant which flows through the water jacket changes. The flow rate of the coolant can be changed by the flow rate control device more promptly compared with the temperature of the coolant. Thus, the flow rate control device can adjust the flow rate of the coolant which flows through the water jacket with high response to the change of the load.

As the flow rate of the coolant which flows through the water jacket becomes lower, the heat transfer coefficient decreases, whereas, as the flow rate of the coolant which flows through the water jacket increases, the heat transfer coefficient increases. The heat generated inside the combustion chamber changes according to the engine load. Therefore, since the controller changes, through the flow rate control device, the flow rate of the coolant which flows through the water jacket according to the engine load, the engine system can adjust a wall temperature of the combustion chamber with high response.

When the engine performs the first combustion, the controller may increase the flow rate of the coolant flowing through the water jacket as the load increases.

As the engine load increases, the heat generated inside the combustion chamber also increases. As the load increases, the flow rate of the coolant flowing through the water jacket increases, and thus, the heat transfer coefficient increases. The wall temperature of the combustion chamber is maintained at the suitable temperature.

When the engine performs the second combustion, the controller may control the flow rate control device to allow the coolant to flow through each of the radiator passage and the bypass passage.

When the engine performs the second combustion (that is, when the air-fuel mixture combusts by the forcible ignition of the spark plug), the thermal efficiency drops compared with when performing the first combustion. The amount of heat released to the wall part of the combustion chamber increases. When the engine performs the second combustion, the controller allows the coolant to flow through each of the radiator passage and the bypass passage, through the flow rate control device. For example, by increasing the flow rate of the coolant flowing through the radiator passage, the coolant temperature is reduced. When the engine performs the second combustion, the wall temperature of the combustion chamber becomes suitable.

When the engine performs the second combustion, the controller may adjust the temperature of the coolant flowing through the water jacket according to the load by adjusting the flow rate of the coolant flowing through the bypass passage and the flow rate of the coolant flowing through the radiator passage.

When the flow rate of the coolant flowing through the radiator passage increases, the coolant temperature decreases. Although when the load becomes high, the heat generated inside the combustion chamber increases, by the temperature of the coolant flowing through the water jacket being adjusted according to the load, the wall temperature of the combustion chamber becomes suitable.

When the engine performs the second combustion, the controller may reduce the flow rate of the coolant flowing through the bypass passage and increase the flow rate of the coolant flowing through the radiator passage, as the load increases.

When the flow rate of the coolant flowing through the radiator passage increases, the coolant temperature decreases. By reducing the coolant temperature when the load is high and the heat generated inside the combustion chamber is also high, the wall temperature of the combustion chamber becomes suitable. On the other hand, when the flow rate of the coolant flowing through the radiator passage decreases, the coolant temperature increases. By increasing the coolant temperature when the load is low and the heat generated inside the combustion chamber is low, the wall temperature of the combustion chamber becomes suitable.

When the engine performs the second combustion, the controller may set the flow rate of the coolant flowing through the water jacket at a maximum flow rate.

When the engine performs the second combustion, the amount of heat released to the wall part of the combustion chamber increases. By making the flow rate of the coolant flowing through the water jacket the maximum flow rate, the wall temperature of the combustion chamber becomes suitable when the engine performs the second combustion.

Both when the engine performs the first combustion and when the engine performs the second combustion, the controller may maintain the wall temperature of the combustion chamber at a constant temperature.

The ideal wall temperature of the combustion chamber when the engine performs the first combustion, does not necessarily match with the ideal wall temperature of the combustion chamber when the engine performs the second combustion. When the engine performs the first combustion, since the air-fuel mixture combusts by self-ignition, the wall temperature of the combustion chamber is preferable to be high in view of stabilizing the ignition. On the other hand, when the engine performs the second combustion, if the wall temperature of the combustion chamber is excessively high, abnormal combustion, such as knocking, may occur. Therefore, changing the wall temperature of the combustion chamber according to the switching of the combustion mode is ideal. However, since the calorific capacity of the wall part of the combustion chamber is large, it is difficult to change the temperature of the wall part of the combustion chamber in a short period of time.

According to this configuration, both when the engine performs the first combustion and when the engine performs the second combustion, the wall temperature of the combustion chamber is maintained at a permissible specific temperature. More specifically, when the engine performs the first combustion, while maintaining the coolant temperature constant by using the thermally-actuated valve, the flow rate of the coolant which flows through the water jacket is adjusted according to the load, and therefore, the wall temperature of the combustion chamber can be maintained at the specific temperature. On the other hand, when the engine performs the second combustion, by adjusting the flow rate of the coolant which flows through the bypass passage and the flow rate of the coolant which flows through the radiator passage so that the temperature of the coolant which flows through the water jacket is adjusted according to the load, the wall temperature of the combustion chamber can be maintained at the same specific temperature. As a result, even when the combustion mode changes, the wall temperature of the combustion chamber becomes suitable.

When the engine performs the second combustion, the controller may lower the temperature of the coolant flowing through the water jacket below a valve-opening temperature of the thermally-actuated valve.

When the engine performs the second combustion, the amount of heat released to the wall part of the combustion chamber increases. By relatively lowering the temperature of the coolant flowing through the water jacket when the engine performs the second combustion, the wall temperature of the combustion chamber becomes suitable.

When the engine performs the first combustion, the amount of heat released to the wall part of the combustion chamber decreases. When the engine performs the first combustion, the coolant temperature is defined by the valve-opening temperature of the thermally-actuated valve as described above. By setting the valve-opening temperature of the thermally-actuated valve at the relatively high temperature, the temperature of the coolant flowing through the water jacket relatively increases, and thus, the wall temperature of the combustion chamber becomes suitable.

In a case where the engine performs the second combustion, when the load is below a given load, the controller may increase the flow rate of the coolant flowing through the radiator passage to lower the temperature of the coolant flowing through the water jacket as the load increases and, when the load is above the given load, the controller may increase the flow rate of the coolant flowing through the radiator passage to maintain the temperature of the coolant flowing through the water jacket constant with respect to the load increase.

When the load is lower than the given load, the temperature of the coolant flowing through the water jacket decreases as the load increases. The wall temperature of the combustion chamber can be maintained at a constant temperature with respect to the load increase. When the load is above the given load, the temperature of the coolant flowing through the water jacket becomes constant as the load increases. The wall temperature of the combustion chamber becomes suitable.

The controller may determine a combustion mode of the engine at least based on an accelerator opening detected, and control the circulation system according to the determined combustion mode.

The combustion mode of the engine may be determined according to at least the accelerator opening, in other words, according to the engine load.

The flow rate control device may be installed at a location branching into the bypass passage and the radiator passage, or a location where the bypass passage and the radiator passage are joined. The circulation system may further have a connecting passage connecting the bypass passage to the radiator passage. The thermally-actuated valve may open and close the connecting passage.

According to this configuration, while the radiator passage is closed, when the coolant temperature increases and the thermally-actuated valve opens, the coolant flows to the radiator passage from the bypass passage. Thus, the coolant temperature decreases. By the thermally-actuated valve, the coolant temperature can be maintained at the given temperature.

The flow rate control device may be installed at a location branching into the bypass passage and the radiator passage, or a location where the bypass passage and the radiator passage are joined. The circulation system may further have a connecting passage bypassing the flow rate control device and connecting the water jacket to the radiator passage. The thermally-actuated valve may open and close the connecting passage.

According to this configuration, while the radiator passage is closed by the flow rate control device, when the coolant temperature increases and the thermally-actuated valve opens, the coolant bypasses the flow rate control device and flows to the radiator passage. Thus, the coolant temperature decreases. Also in this case, by the thermally-actuated valve, the coolant temperature can be maintained at the given temperature.

The flow rate control device may include a housing provided with a first port that is connected to the bypass passage, a second port that is connected to the radiator passage, and a third port that communicates with each of the first port and the second port. The flow rate control device may include a rotary valve body rotatably accommodated in the housing, intervening between the first port, the second port and the third port, and having a first water flow opening that communicates with the first port and a second water flow opening that communicates with the second port. The flow rate control device may further include an actuator that rotates the rotary valve body to change openings of the first water flow opening and the second water flow opening so as to adjust the flow rate of the coolant which flows through each of the first port and the second port.

The flow rate control device having the rotary valve body can selectively close the bypass passage and/or the radiator passage, and can adjust the flow rate of the bypass passage and the flow rate of the radiator passage. The engine system provided with the flow rate control device can realize the flow rate adjustment of the water jacket described above with the simple configuration.

DETAILED DESCRIPTION OF THE DISCLOSURE

Hereinafter, one embodiment of an engine system is described with reference to the accompanying drawings. The engine system described herein is merely illustration.

(Example Configuration of Engine System)

Figure 1:
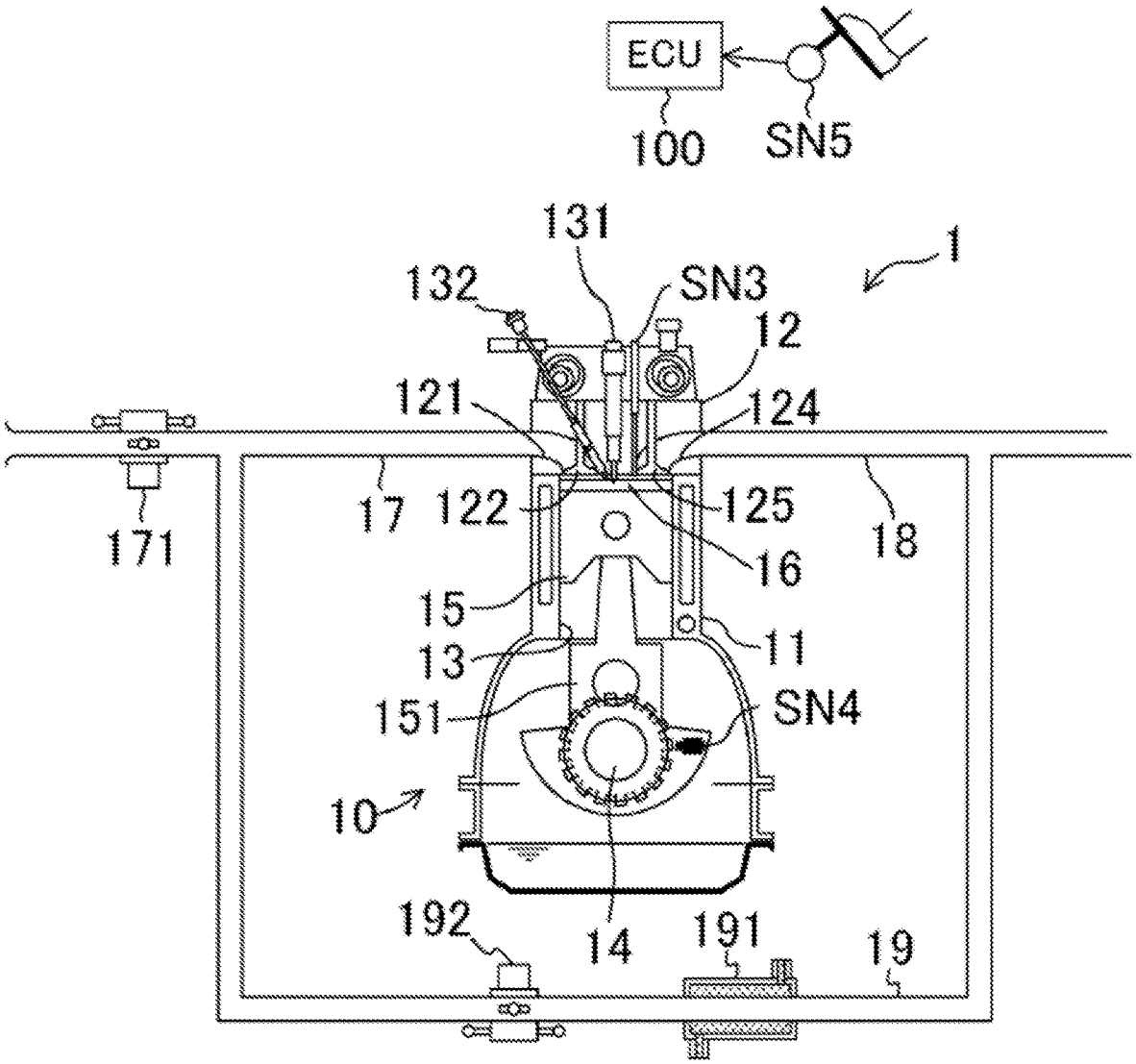
FIG. 1 illustrates an exemplary engine system.
Figure 2:
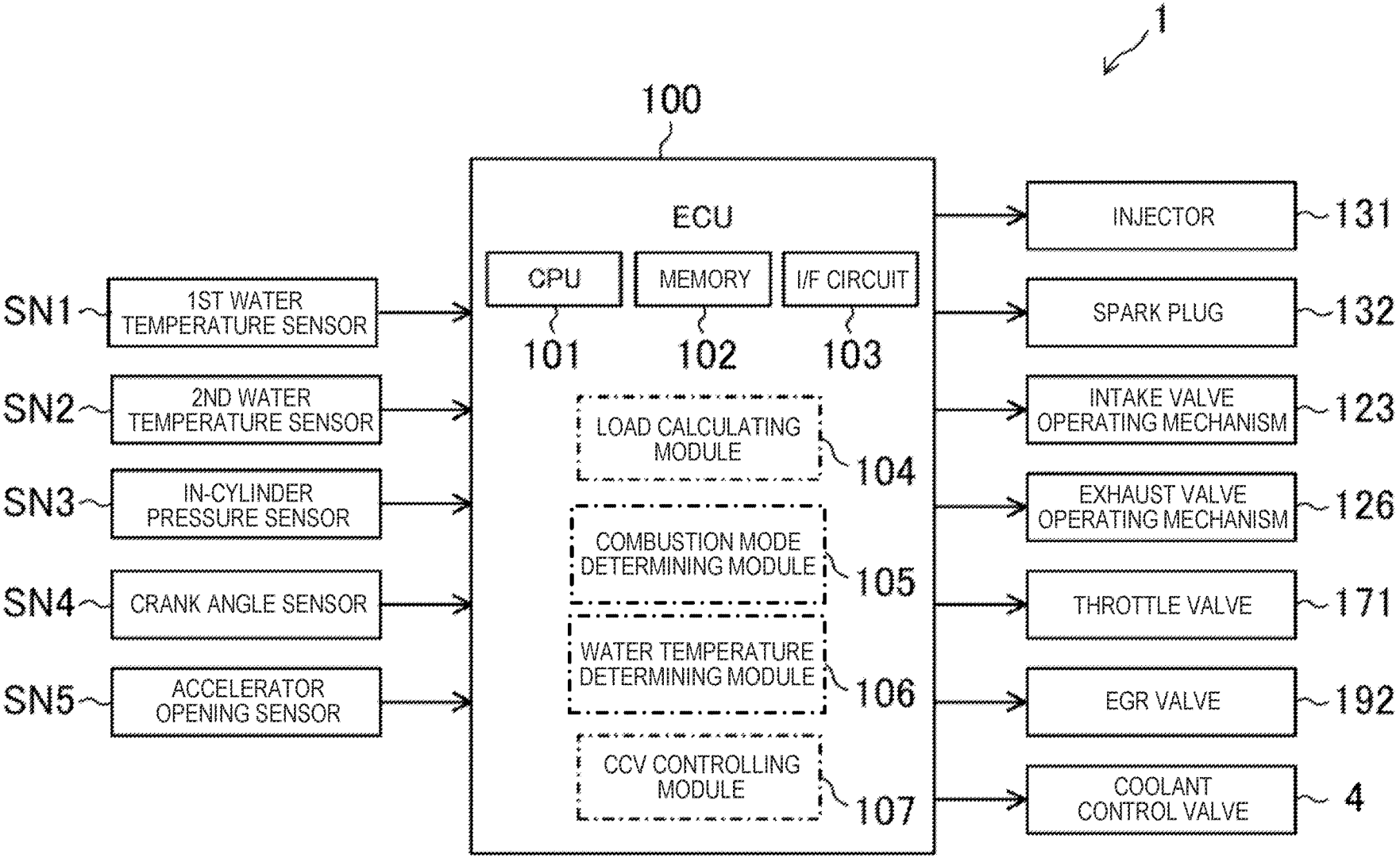
FIG. 2 is a block diagram of the exemplary engine system.

FIGS. 1 and 2 illustrate one example of a configuration of an engine system 1. The engine system 1 is mounted on an automobile. The engine system 1 is provided with an engine 10 which is an internal combustion engine. When the engine 10 operates, the automobile travels. Note that the automobile may be an automobile on which only the engine 10 is mounted as a propelling power source, or may be a hybrid vehicle on which the engine 10 and an electric motor are mounted.

The engine 10 is provided with a cylinder block 11 and a cylinder head 12. A plurality of cylinders 13 are formed in the cylinder block 11. The engine 10 is a multi-cylinder engine.

Figure 4:
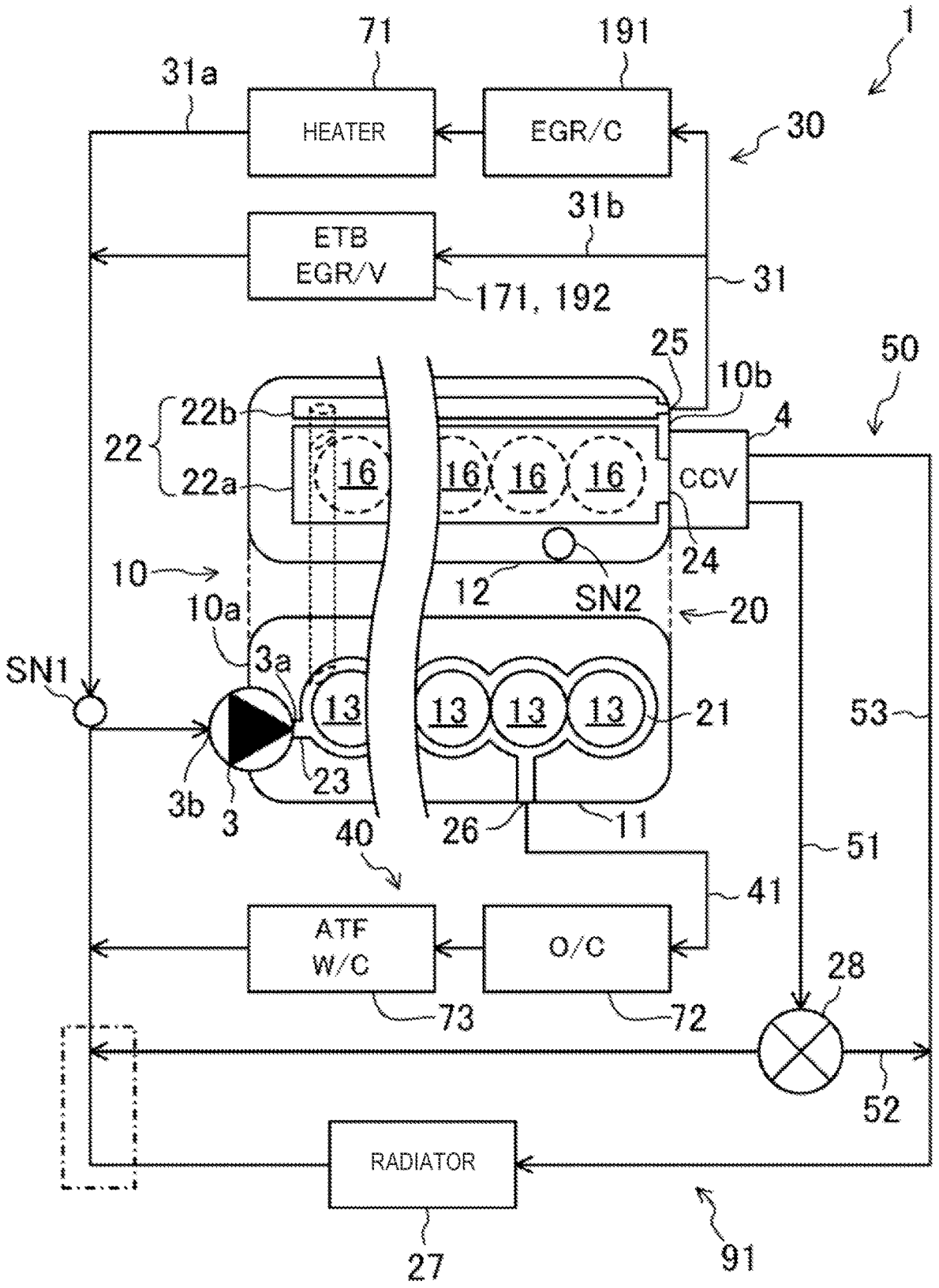
FIG. 4 illustrates an exemplary circulation system.

The plurality of cylinders 13 are lined up along a crankshaft 14 (also see FIG. 4). A piston 15 is inserted in each cylinder 13. The piston 15 is coupled to the crankshaft 14 via a connecting rod 151. The piston 15, the cylinder 13, and the cylinder head 12 form a combustion chamber 16.

An intake port 121 which communicates with each cylinder 13 is formed in the cylinder head 12. An intake valve 122 disposed at the intake port 121 opens and closes the intake port 121. An intake valve operating mechanism 123 (see FIG. 2) opens and closes the intake valve 122 at a given timing. The intake valve operating mechanism 123 is a variable valve operating mechanism which can vary a valve timing and/or a valve lift.

An exhaust port 124 which communicates with each cylinder 13 is formed in the cylinder head 12. An exhaust valve 125 disposed at the exhaust port 124 opens and closes the exhaust port 124. An exhaust valve operating mechanism 126 opens and closes the exhaust valve 125 at a given timing. The exhaust valve operating mechanism 126 is a variable valve operating mechanism which can vary a valve timing and/or a valve lift.

An injector 131 is attached to the cylinder head 12 for every cylinder 13. The injector 131 injects fuel directly into the cylinder 13. A spark plug 132 is attached to the cylinder head 12 for every cylinder 13. The spark plug 132 forcibly ignites an air-fuel mixture inside the cylinder 13.

An intake passage 17 is connected to one side surface of the engine 10. The intake passage 17 communicates with the intake port 121. A throttle valve 171 is disposed at the intake passage 17. The throttle valve 171 adjusts an introducing amount of air into the cylinder 13. An exhaust passage 18 is connected to the other side surface of the engine 10. The exhaust passage 18 communicates with the exhaust port 124.

An exhaust gas recirculation (EGR) passage 19 is connected between the intake passage 17 and the exhaust passage 18. The EGR passage 19 recirculates part of exhaust gas to the intake passage 17. An EGR cooler 191 is disposed at the EGR passage 19. The EGR cooler 191 cools the exhaust gas. An EGR valve 192 is disposed at the EGR passage 19. The EGR valve 192 adjusts a flow rate of exhaust gas which flows through the EGR passage 19.

The engine system 1 is provided with an ECU (Engine Control Unit) 100 for operating the engine 10. The ECU 100 is a controller based on a well-known microcomputer, which includes a CPU (Central Processing Unit) 101, memory 102, and an I/F (interface) circuit 103. The CPU 101 executes a program. The memory 102 is, for example, comprised of RAM (Random Access Memory) and/or ROM (Read Only Memory), and stores the program and data. The I/F circuit 103 inputs and outputs an electric signal. The ECU 100 is one example of a controller.

The ECU 100 is connected to various kinds of sensors SN1-SN5. The sensors SN1-SN5 output signals to the ECU 100. The sensors include the following sensors:

First water temperature sensor SN1: It outputs a signal corresponding to a temperature of coolant which flows into the engine 10, in a circulation system 91 of the coolant (described later);

Second water temperature sensor SN2: It is attached to the engine 10, and outputs a signal corresponding to a temperature of coolant which flows inside the engine 10;

In-cylinder pressure sensor SN3: It is attached to the cylinder head 12, and outputs a signal corresponding to a pressure inside each cylinder 13;

Crank angle sensor SN4: It is attached to the engine 10, and outputs a signal corresponding to a rotation angle of the crankshaft 14; and Accelerator opening sensor SN5: It is attached to an accelerator pedal mechanism, and outputs a signal corresponding to an operating amount of the accelerator pedal.

The ECU 100 determines an operating state of the engine 10 based on the signals from the sensors SN1-SN5, and then calculates a controlled variable of each device according to control logic defined beforehand. The control logic is stored in the memory 102. The control logic includes calculating targeted amounts and/or controlled variables by using a map stored in the memory 102. The ECU 100 outputs electric signals according to the calculated controlled variables to the injector 131, the spark plug 132, the intake valve operating mechanism 123, the exhaust valve operating mechanism 126, the throttle valve 171, the EGR valve 192, and a coolant control valve 4 (described later).

In more detail, the ECU 100 has a load calculating module 104, a combustion mode determining module 105, a water temperature determining module 106, and a CCV controlling module 107 executed by the CPU 101 to perform their respective functions. These modules are stored in the memory 102 as software modules.

The load calculating module 104 calculates a target load of the engine 10 based on the output signal of the accelerator opening sensor SN5. The combustion mode determining module 105 determines an operating range of the engine 10 in a base map 301 (described later, see FIG. 3) based on the load of the engine 10 and the output signal of the crank angle sensor SN4, and determines a combustion mode corresponding to the operating range. The water temperature determining module 106 determines a temperature of coolant which flows through a water jacket 20 (see FIG. 4) around the combustion chamber 16 based on the output signal of the second water temperature sensor SN2. The CCV controlling module 107 cools the engine 10 by controlling the coolant control valve 4 according to the operating state of the engine 10.

(Engine Operation Control Map)

Figure 3:
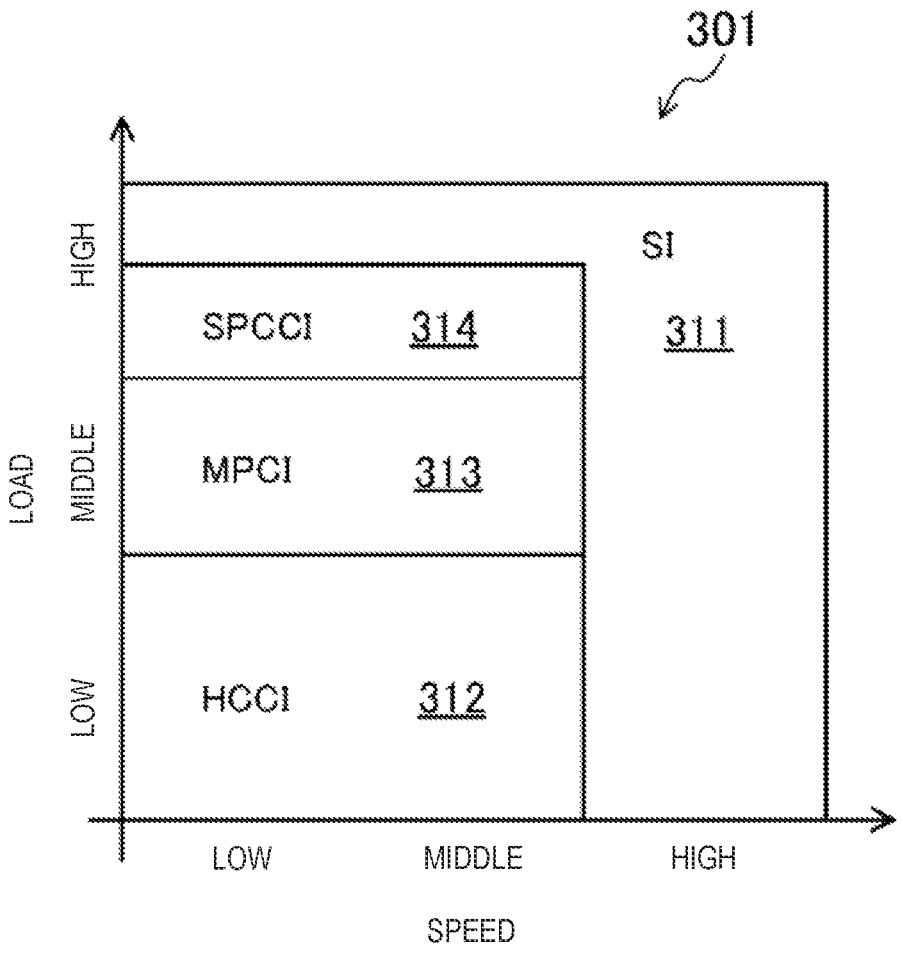
FIG. 3 illustrates an exemplary control map of the engine system.

FIG. 3 illustrates the base map 301 according to the control of the engine 10. The base map 301 is stored in the memory 102 of the ECU 100. The illustrated base map 301 is for a case of the engine 10 being fully warmed up.

The base map 301 is defined by the load and engine speed of the engine 10. The base map 301 is roughly divided into four ranges according to the load and the engine speed. In more detail, a first range 311 includes a range from the low load to high load at a high speed, and a range of the high load at a low speed and a middle speed. A second range 312 is a low-load range at the low speed and the middle speed. A third range 313 is a range from the low load to the middle load at the low speed and the middle speed. A fourth range 314 is a range from the middle load to the high load at the low speed and the middle speed. Note that the low-speed range, the middle-speed range, and the high-speed range may be a low-speed range, a middle-speed range, and a high-speed range when the entire operating range of the engine 10 is divided in the engine speed direction into three substantially equal ranges.

Next, operation of the engine 10 in each range is briefly described. The ECU 100 determines the operating range according to the target load for the engine 10 and the engine speed of the engine 10, and the ECU 100 changes the open-and-close operation of the intake valve 122 and the exhaust valve 125, the fuel injection timing, and the existence of the forcible ignition, according to the determined operating range. Therefore, the combustion mode of the engine 10 changes between SI (Spark Ignition) combustion, HCCI (Homogeneous Charge Compression Ignition) Combustion, MPCI (Multiple Premixed fuel injection Compression Ignition) combustion, and SPCCI (Spark Controlled Compression Ignition) combustion.

(SI Combustion)

When the operating state of the engine 10 is in the first range 311, the ECU 100 carries out flame propagation combustion of the air-fuel mixture inside the cylinder 13. The intake valve operating mechanism 123 opens the intake valve 122 at a given timing and/or by a given lift, and the exhaust valve operating mechanism 126 opens the exhaust valve 125 at a given timing and/or by a given lift. The injector 131 injects fuel into the cylinder 13 during an intake stroke and/or a compression stroke. The spark plug 132 ignites the air-fuel mixture near a compression top dead center.

(HCCI Combustion)

When the operating state of the engine 10 is in the second range 312, the ECU 100 carries out compression ignition combustion of the air-fuel mixture inside the cylinder 13. The intake valve operating mechanism 123 opens the intake valve 122 at a given timing and/or by a given lift, and the exhaust valve operating mechanism 126 opens the exhaust valve 125 at a given timing and/or by a given lift. The injector 131 injects fuel into the cylinder 13 during an intake stroke. The spark plug 132 does not ignite the air-fuel mixture. The air-fuel mixture carries out compression self-ignition and combusts near a compression top dead center.

(MPCI Combustion)

When the operating state of the engine 10 is in the third range 313, the ECU 100 carries out compression ignition combustion of the air-fuel mixture inside the cylinder 13. The intake valve operating mechanism 123 opens the intake valve 122 at a given timing and/or by a given lift, and the exhaust valve operating mechanism 126 opens the exhaust valve 125 at a given timing and/or by a given lift. The injector 131 injects fuel into the cylinder 13 during an intake stroke and a compression stroke. The injector 131 performs a divided injection. The spark plug 132 does not ignite the air-fuel mixture. The air-fuel mixture carries out compression self-ignition and combusts near a compression top dead center.

By the divided injection, the air-fuel mixture inside the cylinder 13 becomes heterogeneous. In this regard, the MPCI combustion differs from the HCCI combustion in which a homogeneous air-fuel mixture is formed. The MPCI combustion allows a control of a timing of the compression self-ignition when the load of the engine 10 is relatively high.

(SPCCI Combustion)

When the operating state of the engine 10 is in the fourth range 314, the ECU 100 carries out flame propagation combustion of part of the air-fuel mixture inside the cylinder 13, and carries out compression ignition combustion of the remaining air-fuel mixture. The intake valve operating mechanism 123 opens the intake valve 122 at a given timing and/or by a given lift, and the exhaust valve operating mechanism 126 opens the exhaust valve 125 at a given timing and/or by a given lift. The injector 131 injects fuel into the cylinder 13 during a compression stroke. The spark plug 132 ignites the air-fuel mixture near a compression top dead center. The air-fuel mixture starts flame propagation combustion. The temperature inside the cylinder 13 becomes high due to generation of combustion heat, and the pressure inside the cylinder 13 increases due to flame propagation. Accordingly, unburnt mixture gas carries out, for example, compression self-ignition after a compression top dead center to start combustion. The flame propagation combustion and the compression ignition combustion progress in parallel after the compression ignition combustion is started.

(Configuration of Circulation System)

Next, a configuration of the circulation system 91 which the engine system 1 has is described with reference to FIG. 4. The circulation system 91 is a device which is attached to the engine 10 and circulates the coolant through the water jacket 20.

The water jacket 20 is formed inside the engine 10. The water jacket 20 constitutes a circuit which is connected to the circulation system 91 and through which the coolant is circulated as well as the circulation system 91. The water jacket 20 has an in-block jacket 21 and an in-head jacket 22. The in-block jacket 21 is formed in the cylinder block 11 so that it spreads along the outer circumference of each cylinder 13.

The in-head jacket 22 is formed in the cylinder head 12. The in-head jacket 22 communicates with the in-block jacket 21 (see broken lines in FIG. 4). The in-head jacket 22 has a first jacket 22*a* and a second jacket 22*b*. The first jacket 22*a* and the second jacket 22*b* are independent from each other.

The first jacket 22*a* is formed so that it extends along an upper part of a plurality of lined-up combustion chambers 16. The coolant which flows through the first jacket 22*a* mainly exchanges heat (mainly, cools) with the combustion chamber 16. In detail, the coolant which flows through the first jacket 22*a* exchanges heat with the atmosphere inside the combustion chamber 16 via a wall surface of the combustion chamber 16.

The second jacket 22*b* is formed so that it extends along a circumference part of the exhaust ports 124 of the plurality of lined-up cylinders 13. The coolant which flows through the second jacket 22*b* mainly exchanges heat (mainly, cools) with the exhaust port 124 where hot exhaust gas flows.

A water pump 3 is installed in the cylinder block 11, at an end of the engine 10 (inflow-side end part 10*a*). The water pump 3 constitutes a part of the circulation system 91.

The water pump 3 is a mechanical pump in which a rotation shaft of the pump is connected with the crankshaft 14 of the engine 10 via a pulley, a belt, etc. The water pump 3 operates by a driving force of the engine 10. Note that the water pump 3 may be an electric rotary pump which can operate independently from the engine 10.

The in-block jacket 21 is connected with a discharge port 3*a* of the water pump 3 via a coolant introducing passage 23. Therefore, the coolant discharged from the water pump 3 flows into the in-block jacket 21 through the coolant introducing passage 23. The coolant which flowed into the in-block jacket 21 flows into the in-head jacket 22. In detail, it dividedly flows into the first jacket 22*a* and the second jacket 22*b*.

The coolant control valve (CCV) 4 (an example of a "flow rate control device" in the disclosed art) is installed in the cylinder head 12, at an end (outflow-side end part 10*b*) opposite from the inflow-side end part 10*a* of the engine 10. The coolant control valve 4 constitutes a part of the circulation system 91.

A third port 65 (see FIG. 5) of the coolant control valve 4 is connected with the first jacket 22*a* via a first coolant deriving passage 24. Therefore, the coolant which flows through the first jacket 22*a* flows out of the engine 10 through the first coolant deriving passage 24, and flows into the coolant control valve 4 (the details of the coolant control valve 4 will be described later).

A second coolant deriving passage 25 which communicates with the second jacket 22*b* is formed in a part of the outflow-side end part 10*b*, on the exhaust side of the cylinder head 12. Therefore, the coolant which flows through the second jacket 22*b* flows out of the engine 10 through the second coolant deriving passage 25, and flows into a second circulation flow passage 31 (described later).

A third coolant deriving passage 26 which communicates with the in-block jacket 21 is formed in a part of the outflow-side end part 10*b*, on the intake side of the cylinder block 11. Therefore, part of the coolant which flows through the in-block jacket 21 flows out of the engine 10 through the third coolant deriving passage 26, and flows into a third circulation flow passage 41 (described later).

The circulation system 91 includes, in addition to the water pump 3 and the coolant control valve 4 which are described above, a radiator 27 (an example of a "heat exchanger" in the disclosed art), and a thermally-actuated valve (thermostat valve) 28. Further, the engine system 1 including the circulation system 91 roughly includes, as passages through which the coolant is circulated, a second circuit 30, a third circuit 40, and a first circuit 50.

(Second Circuit)

The second circuit 30 has the second circulation flow passage 31 which is provided with a passage which branches into two (a first branch passage 31*a* and a second branch passage 31*b*). In the first branch passage 31*a*, the EGR cooler 191 and a heater 71 are disposed. The heater 71 is built into an air-conditioner which adjusts air inside a vehicle cabin. In the second branch passage 31*b*, the throttle valve (Electric Throttle Body: ETB) 171 and the EGR valve 192 are disposed. An upstream end of the second circulation flow passage 31 is connected to the second coolant deriving passage 25. A downstream end of the second circulation flow passage 31 is connected to a suction port 3*b* of the water pump 3 in a state where it is joined to the first circuit 50 and the third circuit 40.

Inside of the engine 10, the in-block jacket 21, the second jacket 22*b*, and the second coolant deriving passage 25 constitute a passage of the second circuit 30. Therefore, in the second circuit 30, coolant which flowed through the in-block jacket 21 and the second jacket 22*b* among the coolant discharged from the water pump 3 dividedly flows into the first branch passage 31*a* and the second branch passage 31*b*. Then, it returns to the water pump 3 after being joined.

The coolant which flows through the second circuit 30 exchanges heat with the engine 10 (mainly, with the exhaust port 124). Further, it also exchanges heat with the EGR cooler 191, the heater 71, the throttle valve 171, and the EGR valve 192.

(Third Circuit)

The third circuit 40 has the third circulation flow passage 41 in which an oil cooler 72 and an automatic transmission fluid (ATF) heat exchanger 73 are installed. The oil cooler 72 is installed in a system which circulates and supplies lubricating oil to the engine 10. The ATF heat exchanger 73 is installed in a system which circulates and supplies hydraulic fluid of an automatic transmission. An upstream end of the third circulation flow passage 41 is connected to the third coolant deriving passage 26. A downstream end of the third circulation flow passage 41 is connected to the suction port 3*b* of the water pump 3 in a state where it is joined to the first circuit 50 and the second circuit 30.

Inside of the engine 10, the in-block jacket 21 and the third coolant deriving passage 26 constitute a passage of the third circuit 40. Therefore, in the third circuit 40, among the coolant discharged from the water pump 3, part of the coolant which flows through the in-block jacket 21 flows through the third circulation flow passage 41 and returns to the water pump 3. The coolant which flows through the third circuit 40 exchanges heat with the oil cooler 72 and the ATF heat exchanger 73.

(First Circuit)

The first circuit 50 has a bypass passage 51, a connecting passage 52, and a radiator passage 53. Inside of the engine 10, the in-block jacket 21, the first jacket 22*a*, and the first coolant deriving passage 24 constitute a passage of the first circuit 50.

The passage of the first circuit 50 branches to the bypass passage 51 and the radiator passage 53 at the coolant control valve 4. The downstream ends of the bypass passage 51 and the radiator passage 53 are connected to the suction port 3*b* of the water pump 3 in a state where they are joined to the second circuit 30 and the third circuit 40.

The radiator 27 is provided to the radiator passage 53. The radiator 27 is installed behind a front grille of the automobile. The coolant which flows through the radiator 27 exchanges heat mainly with outside air flow caused by the automobile traveling. The coolant radiates the heat and is cooled by flowing through the radiator passage 53.

Therefore, the radiator passage 53 cools, by the radiator 27, the coolant which is discharged from the water pump 3 and is heated by exchanging heat while flowing through the in-block jacket 21 and the first jacket 22*a*, and recirculates it to the in-block jacket 21 and the first jacket 22*a*.

The bypass passage 51 is a passage which bypasses the radiator passage 53. The bypass passage 51 is shorter than the radiator passage 53. Only the thermally-actuated valve 28 is provided to the bypass passage 51. The thermally-actuated valve 28 is connected by the radiator passage 53 via the connecting passage 52 in a state where the upstream side and the downstream side of the bypass passage 51 always communicate with each other.

Therefore, the bypass passage 51 recirculates to the in-block jacket 21 and the first jacket 22*a* the coolant which was discharged from the water pump 3 and exchanged heat while flowing through the in-block jacket 21 and the first jacket 22*a*, without cooling the coolant by the radiator 27.

The thermally-actuated valve 28 is a known device which opens and closes at a high temperature set beforehand. The thermally-actuated valve 28 has a valve body which is biased in a closing direction by an elastic force of a spring. The thermally-actuated valve 28 opens and closes by the valve body being displaced according to an action of wax. The thermally-actuated valve 28 of the engine system 1 is set so that its valve-opening temperature is higher than a valve-opening temperature of a conventional thermally-actuated valve.

When the thermally-actuated valve 28 opens, the bypass passage 51 communicates the radiator passage 53 via the connecting passage 52. Therefore, when the thermally-actuated valve 28 opens, part of the coolant which flows through the bypass passage 51 passes through the connecting passage 52, and flows into the radiator passage 53.

(Coolant Control Valve)

Figure 5:
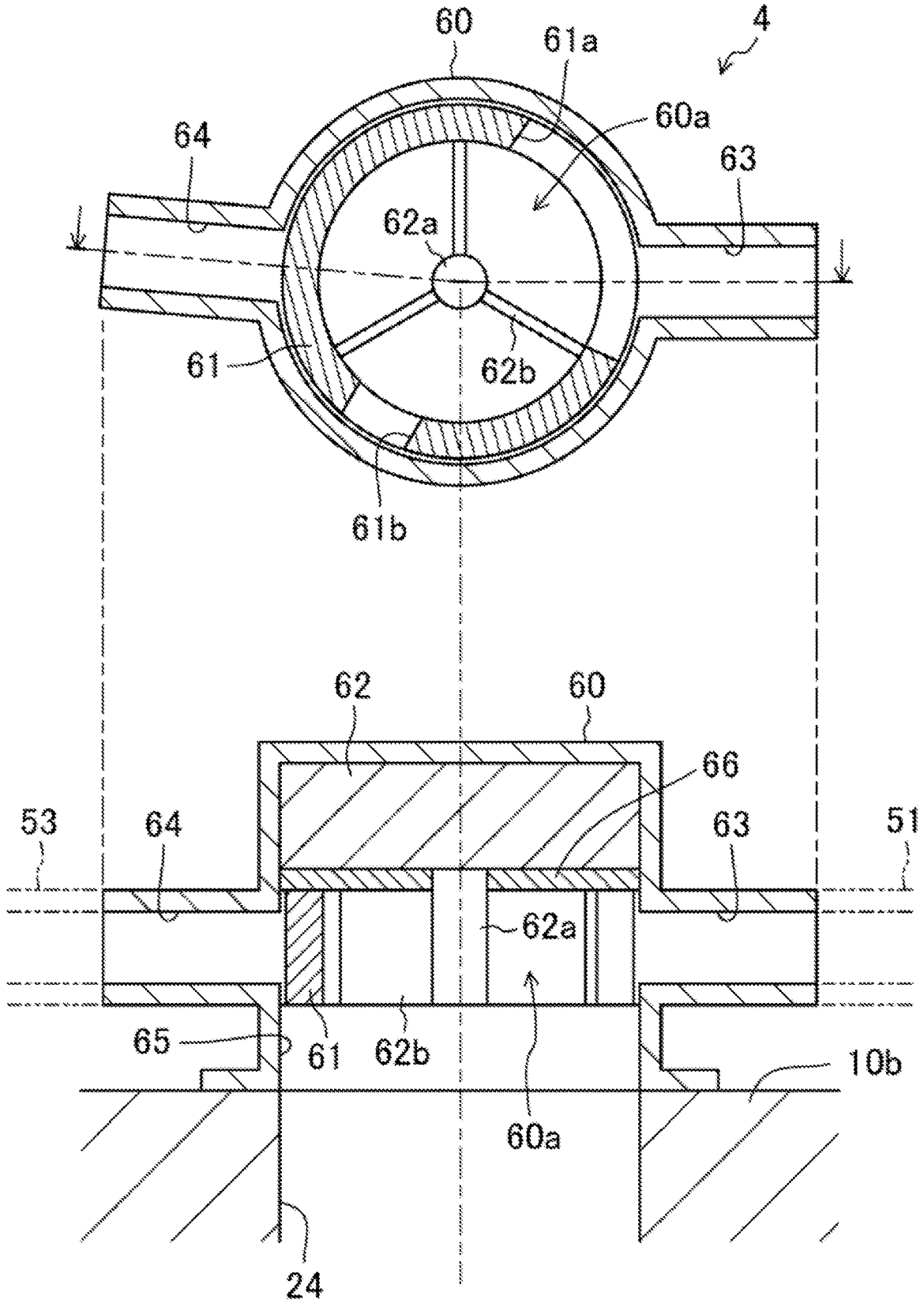
FIG. 5 illustrates an exemplary flow rate control device.

FIG. 5 illustrates the coolant control valve 4. The coolant control valve 4 is a valve which can adjust a flow rate of the coolant, and is comprised of a housing 60, a rotary valve body 61, and an actuator 62.

A cylindrical flow-dividing chamber 60*a* is provided inside the housing 60. The cylindrical rotary valve body 61 is rotatably accommodated in the flow-dividing chamber 60*a*. A first port 63 and a second port 64 are formed in the housing 60 so that they extend radially outward from a given position in an outer circumference of the flow-dividing chamber 60*a*. The first port 63 is connected to the bypass passage 51. The second port 64 is connected to the radiator passage 53.

One end of the flow-dividing chamber 60*a* is opened. This opening constitutes the third port 65 through which the coolant flows into the flow-dividing chamber 60*a*. Further, the housing 60 is attached to the cylinder head 12 so that the third port 65 is coaxially connected to the first coolant deriving passage 24. Therefore, a circumferential wall of the rotary valve body 61 intervenes between the third port 65 and each of the first port 63 and the second port 64.

A first water flow opening 61*a* and a second water flow opening 61*b* are formed at given positions of the circumferential wall of the rotary valve body 61. The first water flow opening 61*a* has a length in the circumferential direction longer than the second water flow opening 61*b*, and has a relatively large opening area. Depending on the rotational position of the rotary valve body 61, the third port 65 communicates or does not communicate with the first port 63 and the second port 64 via the first water flow opening 61*a* and the second water flow opening 61*b*, respectively. Further, when communicating with the ports, an opening between each of the first port 63 and the second port 64 and the third port 65 varies depending on the rotational position of the rotary valve body 61.

The other end of the flow-dividing chamber 60*a* is sealed with a closure wall 66. The actuator 62 is accommodated inside the housing 60, on the opposite side of the flow-dividing chamber 60*a* with respect to the closure wall 66. A rotation shaft 62*a* of the actuator 62 projects into the flow-dividing chamber 60*a* through a shaft hole which opens at the center of the closure wall 66. The rotary valve body 61 is attached via support arms 62*b* to the rotation shaft 62*a* projected into the flow-dividing chamber 60*a*. The ECU 100 outputs a control signal to the actuator 62. By the ECU 100 controlling the actuator 62, the rotary valve body 61 is rotated.

Returning to FIG. 4, the first water temperature sensor SN1 is disposed at a passage where the first circuit 50, the second circuit 30, and the third circuit 40 join and flow into the water pump 3. The second water temperature sensor SN2 is disposed at the first jacket 22*a*. The first water temperature sensor SN1 measures a temperature of coolant which flows into the engine 10. The second water temperature sensor SN2 measures a temperature of coolant which flows into the water jacket 20 (more accurately, into the first jacket 22*a*). These sensors SN1 and SN2 are utilized for a coolant control and a combustion control. For example, when performing the advanced combustion control, the second water temperature sensor SN2 is utilized for estimating the wall temperature of the combustion chamber 16. The second water temperature sensor SN2 is utilized for controlling the actuator 62.

In this circulation system 91, the ECU 100 controls the coolant control valve 4 based on the measurement of the second water temperature sensor SN2. This adjusts a flow rate of the coolant which flows through the first circuit 50 (i.e., the bypass passage 51 and the radiator passage 53). Note that the flow of the coolant in the connecting passage 52 is automatically adjusted by the thermally-actuated valve 28.

The coolant which flows through the circulation system 91 is mainly cooled by the radiator 27 installed in the radiator passage 53. The temperature of the coolant is adjusted.

That is, the main object of the circulation system 91 is the first circuit 50. The flow rate and the temperature of the coolant in each of the second circuit 30 and the third circuit 40 change according to an adjustment of the flow rate and the temperature of the coolant in the first circuit 50. In this circulation system 91, although the first circuit 50 is essential, the second circuit 30 and the third circuit 40 are not essential.

(How Coolant Flows)

Figure 6:
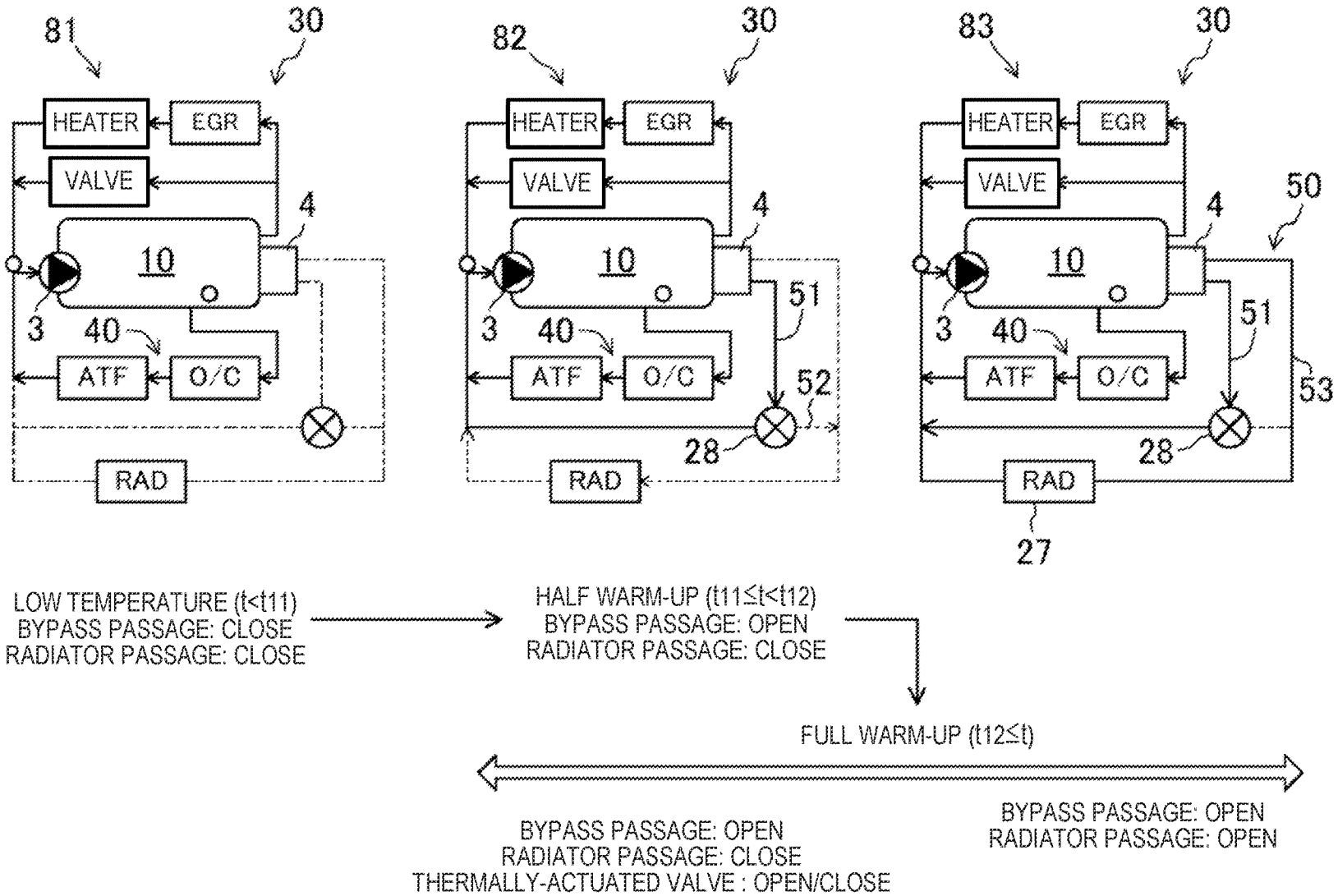
FIG. 6 illustrates an exemplary control of the circulation system.

As described above, the coolant which flows through the first jacket 22*a* mainly exchanges heat with the wall part of the combustion chamber 16 to cool the wall part of the combustion chamber 16. In this engine system 1, a plurality of ways for the coolant to flow are set according to the temperature of the coolant which flows through the first jacket 22*a* (the measurement of the second water temperature sensor SN2) in order to stably and efficiently perform the combustion control of the engine 10. FIG. 6 illustrates a flowing state of each circuit in the engine system 1 according to the temperature of the coolant.

In the coolant control valve 4, the actuator 62 is controlled to adjust the flow rate of the coolant which flows through both the first port 63 and the second port 64. That is, the opening of each of the first water flow opening 61*a* and the second water flow opening 61*b* is changed so that the rotary valve body 61 is at the given rotational position.

"Low Temperature" is a so-called state during "cold start," such as immediately after the engine 10 is started. "Low Temperature" is a state where a temperature t of the coolant which flows through the first jacket 22*a* is below a first switching temperature t11 (for example, 40° C.). "Full Warm-up" is a state where the engine 10 is warmed up to a temperature suitable for operation, and is a so-called state after "warmed up." "Full Warm-up" is a state where the temperature t of the coolant which flows through the first jacket 22*a* is at or above a second switching temperature t12 (for example, 80° C.). "Half Warm-up" is a state between "Low Temperature" and "Full Warm-up" (i.e., it is a transition state). "Half Warm-up" is a state where the temperature t of the coolant which flows through the first jacket 22*a* is at or above the first switching temperature t11 and below the second switching temperature t12, and it is a state where the coolant temperature t is from 40° C. to 80° C.

As illustrated by a left state 81 in FIG. 6, the coolant neither flows into the bypass passage 51 nor the radiator passage 53 during "Low Temperature" (both the flow rates are zero). That is, in the first circuit 50, the circulation of the coolant is not performed. At this time, in the coolant control valve 4, the rotary valve body 61 is set at a rotational position where both the first port 63 and the second port 64 do not communicate with the third port 65.

Since the coolant does not flow into the radiator passage 53, the coolant will not be cooled by the radiator 27. Therefore, the coolant rises promptly in the temperature. Further, the combustion chamber 16 is not cooled by the circulation of the coolant. The combustion chamber 16 can be promptly heated by the combustion heat. Since the engine 10 promptly rises to the temperature state suitable for combustion, fuel efficiency can be improved. At this time, the coolant discharged from the water pump 3 circulates through the second circuit 30 and the third circuit 40.

As illustrated by a center state 82 in FIG. 6, during "Half Warm-up," although the coolant flows into the bypass passage 51, the coolant does not flow into the radiator passage 53 (the flow rate of the radiator passage 53 is zero). That is, in the first circuit 50, the coolant only circulates through the bypass passage 51. At this time, in the coolant control valve 4, the rotary valve body 61 is set at a rotational position where only the first port 63 communicates with the third port 65. The opening of the first water flow opening 61*a* is fully open, for example.

Since the coolant does not flow into the radiator passage 53, the coolant promptly rises in the temperature. On the other hand, since the coolant flows into the bypass passage 51, the coolant flows into the first jacket 22*a*. The bypass passage 51 is short. Further, since the coolant control valve 4 is set to be fully opened, most of the coolant flows through the bypass passage 51 and the first jacket 22*a*.

The combustion chamber 16 can be promptly heated by the circulating coolant. Since the coolant is circulated, the combustion chamber 16 and its circumference can be heated uniformly. Since the engine 10 promptly rises to the temperature state suitable for combustion, fuel efficiency can be improved.

Note that, at this time, the remainder of the coolant discharged from the water pump 3 circulates through the second circuit 30 and the third circuit 40 (similar during "Full Warm-up"). The temperature of the coolant during "Half Warm-up" is lower than the valve-opening temperature of the thermally-actuated valve 28. Therefore, the thermally-actuated valve 28 is in a fully closed state. Part of the coolant will not flow into the radiator passage 53 from the bypass passage 51.

During "Full Warm-up," the engine 10 reaches the temperature state suitable for combustion. The engine 10 after fully warmed up changes the combustion mode according to the load and the engine speed, as described above. This engine system 1 controls the circulation system 91 so that the wall temperature of the combustion chamber 16 becomes a temperature suitable for the combustion mode. During "Full Warm-up," the state 82 illustrated in the center of FIG. 6 and a state 83 illustrated in the right of FIG. 6 are switched according to the operating state of the engine 10. The state 82 is a state where the bypass passage 51 is opened and the radiator passage 53 is closed, as described above. However, since the temperature of the coolant rises during "Full Warm-up," the coolant may flow through the radiator passage 53 by the thermally-actuated valve 28 being opened, as will be described later. The state 83 is a state where the circulation of the coolant is performed using the entire first circuit 50 by opening both the bypass passage 51 and the radiator passage 53.

In more detail, during "Full Warm-up," as illustrated by the center state 82, in the coolant control valve 4, the rotary valve body 61 is set at a rotational position so that the first port 63 communicates with the third port 65, and the second port 64 does not communicate with the third port 65. Further, according to the load of the engine 10, the flow rate of the coolant is adjusted at the first port 63 (bypass passage 51).

During "Full Warm-up," as illustrated by the right state 83, the coolant flows into both the bypass passage 51 and the radiator passage 53. In that case, in the coolant control valve 4, the rotary valve body 61 is set at a rotational position so that both the first port 63 and the second port 64 communicate with the third port 65. Further, according to the load of the engine 10, the flow rate of the coolant is adjusted at both the first port 63 (bypass passage 51) and the second port 64 (radiator passage 53).

(How Coolant Flows when Fully Warmed Up)

Figure 7:
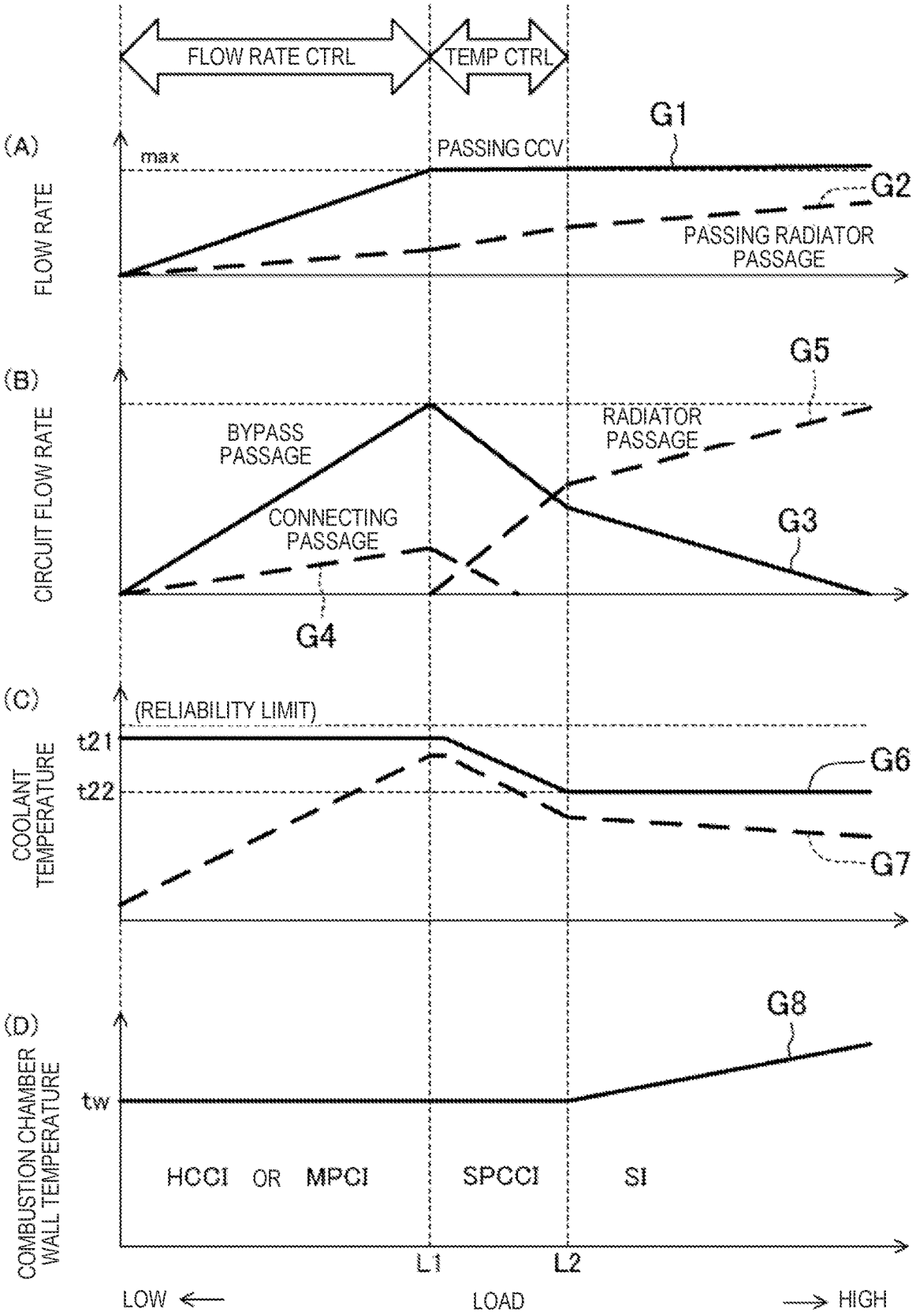
FIG. 7 illustrates an exemplary control of the circulation system.

FIG. 7 illustrates a concrete example of how the coolant flows when fully warmed up. In FIG. 7, charts (A) to (D) illustrate changes in main properties according to the load of the engine 10.

Chart (A) illustrates change G1 in the flow rate of the coolant which passes through the coolant control valve 4, and change G2 in the flow rate of the coolant which passes through the radiator passage 53. Chart (B) illustrates the details of the change in the flow rate of the coolant which flows through the first circuit 50, that is, change G3 in the flow rate of the coolant which flows into the bypass passage 51 from the coolant control valve 4, change G4 in the flow rate of the coolant which flows through the connecting passage 52, and change G5 in the flow rate of the coolant which flows into the radiator passage 53 from the coolant control valve 4.

Chart (C) illustrates change G6 in the temperature of the coolant which flows through the first jacket 22*a*, and change G7 in the temperature of the coolant which flows into the water pump 3. In other words, changes in the measurements of the second water temperature sensor SN2 and the first water temperature sensor SN1 are illustrated. Chart (D) illustrates change G8 in the wall temperature of the combustion chamber 16.

The load range of the engine 10 is divided, in association with the control of the coolant, into three ranges comprised of a range below the first load L1, a range above the second load L2, and a range above the first load L1 and below the second load L2. Each chart of FIG. 7 corresponds to the case where the engine speed of the engine 10 is the low speed or the middle speed. The range below the first load L1 is a range where the engine 10 performs HCCI combustion or MPCI combustion. The range above the second load L2 is a range where the engine 10 performs SI combustion. The range above the first load L1 and below the second load L2 is a range where the engine 10 performs SPCCI combustion.

Further, in this engine system 1, the flow rate control of the coolant is performed in the range where the engine 10 performs HCCI combustion or MPCI combustion, and the temperature control of the coolant is performed in the range where the engine 10 performs SPCCI combustion. The range where the engine 10 performs HCCI combustion or MPCI combustion is, in other words, a range where the air-fuel mixture combusts without forcible ignition of the spark plug 132, and the range where the engine 10 performs SPCCI combustion is a range where the air-fuel mixture combusts by the forcible ignition of the spark plug 132.

The engine system 1 maintain the wall temperature of the combustion chamber 16 at the specific constant temperature in the ranges where the load of the engine 10 is low and middle by switching between the flow rate control and the temperature control (see G8).

That is, in order to realize the compression self-ignition combustion without forcible ignition, like HCCI combustion or MPCI combustion, it is necessary to accurately control the temperature inside the combustion chamber 16 (in-cylinder temperature) at a temperature higher than SI combustion. On the other hand, SPCCI combustion is combustion accompanied by forcible ignition though part of the air-fuel mixture combusts by compression ignition, and the temperature inside the combustion chamber 16 is permitted to be lower than that of HCCI combustion or MPCI combustion. On the contrary, if the temperature inside the combustion chamber 16 is too high, the air-fuel mixture may carry out self-ignition before forcible ignition is performed, or a rate of the self-ignition combustion may become too large in the SPCCI combustion where flame propagation combustion and self-ignition combustion are combined. That is, if the temperature inside the combustion chamber 16 is too high, stable SPCCI combustion will not be realized.

Therefore, it is ideal to change the wall temperature of the combustion chamber 16 according to the switching of the combustion mode. However, since the calorific capacity of the wall part of the combustion chamber 16 is large, it is difficult to change the wall temperature of the combustion chamber 16 with sufficient response to the switching of the combustion mode or the change in the load. Thus, in the range from the low load to the middle load, the engine system 1 maintains the wall temperature of the combustion chamber 16 at the specific constant temperature. This specific temperature is an intermediate temperature between an optimal temperature for HCCI combustion or MPCI combustion and an optimal temperature for SPCCI combustion, is a temperature permissible in the execution of HCCI combustion or MPCI combustion, and is a temperature also permissible in the execution of SPCCI combustion. Even if the combustion mode is switched or the load is changed, the wall temperature of the combustion chamber 16 becomes a suitable temperature by maintaining the wall temperature of the combustion chamber 16 at the constant temperature.

However, if the load of the engine 10 is low, the combustion heat increases in general, and if the load of the engine 10 increases, the combustion heat decreases in general. In order to maintain the constant wall temperature of the combustion chamber 16 regardless of the load of the engine 10, it is necessary to adjust the heat exchanging quantity by the coolant with high response to the occurring combustion heat.

For example, in order to adjust the heat exchanging quantity, it is possible to adjust the temperature of the coolant according to the load of the engine 10. However, since the calorific capacity of the coolant is large, it requires a long period of time to raise or lower the temperature of the coolant. It is difficult to adjust the temperature of the coolant with high response to the change in the load of the engine 10.

Thus, this engine system 1 adjusts the flow rate of the coolant which flows through the first port 63 and the first jacket 22*a* by using the coolant control valve 4 according to the load of the engine 10, while keeping the temperature of the coolant constant at a given temperature. Since the adjustment of the flow rate can be changed with high response, the heat transfer coefficient by the coolant can be adjusted with high response against the occurring combustion heat, and, as a result, the wall temperature of the combustion chamber 16 can be maintained constant.

(Range of HCCI Combustion or MPCI Combustion)

As illustrated in FIG. 7, in the range where HCCI combustion or MPCI combustion is performed, the coolant control valve 4 adjusts the flow rate of the coolant which flows through the bypass passage 51 without the coolant flowing to the radiator passage 53 (see G3, G5).

Since the radiator passage 53 is closed, the temperature of the coolant is determined by a valve-opening temperature of the thermally-actuated valve 28. The valve-opening temperature of the thermally-actuated valve 28 is set at a comparatively high temperature. The temperature of the coolant which flows through the first jacket 22*a* is constant at a first target temperature t21, regardless of the load (see G6). The first target temperature t21 is a temperature near the reliability limit temperature of the engine 10. By setting the temperature of the coolant at the comparatively high temperature, in the range where HCCI combustion or MPCI combustion is performed, the wall temperature of the combustion chamber 16 can be maintained at the comparatively high temperature (that is, a target temperature tw). When the wall temperature of the combustion chamber 16 is high, it is advantageous to stabilize the compression self-ignition combustion without forcible ignition like HCCI combustion or MPCI combustion. Note that, in the example of the drawing, in the range below the first load L1, the temperature of the coolant which flows into the engine 10 gradually rises as the load of the engine 10 increases (see G7).

In the range where HCCI combustion or MPCI combustion is performed, the coolant control valve 4 adjusts the flow rate so that the flow rate of the coolant which flows through the bypass passage 51 becomes less when the load of the engine 10 is low, and the flow rate of the coolant which flows through the bypass passage 51 becomes more when the load of the engine 10 is high.

At this time, in the coolant control valve 4, the actuator 62 is controlled so that the rotary valve body 61 is located at a rotational position where the third port 65 does not communicate with the second port 64 and the third port 65 communicates with the first port 63. Further, according to the load of the engine 10, the opening between the third port 65 and the first port 63 is adjusted.

Note that, in the range where HCCI combustion or MPCI combustion is performed, the flow rate of the coolant which flows through the connecting passage 52 when the thermally-actuated valve 28 is opened changes corresponding to the change in the flow rate of the coolant which flows through the bypass passage 51 (see G4).

Here, in the example of the drawing, although the load of the engine 10 and the flow rate of the coolant have a linear relationship, it is not limited to the linear relationship.

The flow rate of the coolant which flows through the first jacket 22*a* corresponds to the flow rate of the coolant which flows through the bypass passage 51. Therefore, when the load of the engine 10 is low, the flow rate of the coolant which flows through the first jacket 22*a* is small, and when the load of the engine 10 is high, the flow rate of the coolant which flows through the first jacket 22*a* is large. In the example of FIG. 7, when the load of the engine 10 is the first load L1, the flow rate of the coolant which flows through the first jacket 22*a* becomes the maximum flow rate (see G1). Note that when the load of the engine 10 is the first load L1, the flow rate of the coolant which flows through the first jacket 22*a* may be below the maximum flow rate.

When the flow rate of the coolant which flows through the first jacket 22*a* is small, the heat transfer coefficient with the combustion chamber 16 falls. Therefore, even if the combustion heat decreases, the wall temperature of the combustion chamber 16 can be adjusted to a high temperature. When the flow rate of the coolant which flows through the first jacket 22*a* is large, the heat transfer coefficient with the combustion chamber 16 increases. Therefore, even if the combustion heat increases, the wall temperature of the combustion chamber 16 can be adjusted to a low temperature.

In this way, while maintaining the temperature of the coolant constant by using the thermally-actuated valve 28 (see G6), the flow rate of the coolant which flows through the first jacket 22*a* is fluctuated using the coolant control valve 4 with high response according to the load of the engine 10 (see G1, G3). Therefore, the wall temperature of the combustion chamber 16 can be held constant at the target temperature tw (see G8).

(Range of SPCCI Combustion)

The flow rate of the coolant which flows through the coolant control valve 4 (i.e., the flow rate of the coolant which flows through the first circuit 50) reaches an upper limit at the first load L1 (see G1). That is, the flow rate control cannot be performed at the load above the first load L1. Thus, in the range above the first load L1 and below the second load L2, the temperature control of the coolant is performed. The wall temperature of the combustion chamber 16 is held at the target temperature tw by gradually allowing the coolant which flows through the bypass passage 51 to flow to the radiator passage 53 as the load of the engine 10 increases, to cool the coolant.

In detail, in a state where the flow rate of the coolant which flows through the first circuit 50 is held at the maximum flow rate, the coolant control valve 4 gradually increases the flow rate of the coolant which flows through the radiator passage 53, while gradually reducing the flow rate of the coolant which flows through the bypass passage 51, as the load of the engine 10 increases (see G1, G2, G3, G5). In the range of SPCCI combustion, the coolant control valve 4 adjusts the temperature of the coolant which flows through the first jacket 22*a* by adjusting the flow rate of the coolant which flows through the radiator passage 53. Note that if the load of the engine 10 is above the first load L1, the flow rate of the coolant which flows through the radiator passage 53 exceeds the flow rate of the coolant which flows through the bypass passage 51. The load of the engine 10 at which the flow rate is reversed changes according to the operating environments of the engine 10 (for example, ambient temperature, wind quantity during the vehicle traveling, etc.).

The coolant control valve 4 controls the actuator 62 so that the rotary valve body 61 is located at a rotational position where the third port 65 communicates with both the first port 63 and the second port 64. Further, according to the load of the engine 10, the opening between the third port 65 and each of the first port 63 and the second port 64 is adjusted.

Thus, the temperature of the coolant which flows through the first jacket 22*a* and the temperature of the coolant which flows into the engine 10 become lower as the load of the engine 10 increases (see G6, G7). When the load of the engine 10 increases to increase the combustion heat, since the temperature of the coolant which flows through the first jacket 22*a* is low even if the flow rate of the coolant is constant, the cooling quantity by the coolant which flows through the first jacket 22*a* can be maintained. Further, since the flow rate of the coolant which flows through the first circuit 50 is the maximum flow rate, it is advantageous to cool the combustion chamber 16. As a result, also in the range of SPCCI combustion, the wall temperature of the combustion chamber 16 can be held at the target temperature tw (see G8).

In order to suppress the excessive rise in the temperature of the combustion chamber 16, in this cooling system, a second target temperature t22 (for example, 88° C.) lower than the first target temperature t21 is set as a target temperature of the coolant which flows through the first jacket 22*a*. The temperature control is performed until the temperature of the coolant which flows through the first jacket 22*a* reaches the second target temperature t22.

Note that, as illustrated in G5 of FIG. 7, when the temperature of the coolant reaches the second target temperature t22, the flow rate of the coolant which flows through the radiator passage 53 is below the maximum flow rate. If the flow rate of the coolant which flows through the radiator passage 53 is further increased, the temperature of the coolant can be further reduced. That is, even if the load of the engine 10 exceeds L2, it is possible to maintain the wall temperature of the combustion chamber 16 at the target temperature tw.

Thus, the engine system 1 can maintain the wall temperature of the combustion chamber 16 constant over the wide range from the low load to the middle load of the engine 10, by the combination of the flow rate control and the temperature control. Since the wall temperature of the combustion chamber 16 is maintained at the suitable temperature even if the combustion mode is switched between HCCI combustion, MPCI combustion, and SPCCI combustion corresponding to the change in the load of the engine 10, each combustion is stably performed.

The coolant control valve 4 having the rotary valve body 61 can selectively close the bypass passage 51 and/or the radiator passage 53, and can adjust the flow rate of the bypass passage 51 and the flow rate of the radiator passage 53. The engine system 1 provided with the coolant control valve 4 can realize the flow rate adjustment of the water jacket 20 described above with the simple configuration.

Note that, in the range of SPCCI combustion, the coolant which flows into the radiator passage 53 through the connecting passage 52 gradually decreases and will not flow as the load of the engine 10 increases (see G4). In detail, the temperature of the coolant which flows into the bypass passage 51 from the coolant control valve 4 gradually decreases from the first target temperature t21. In connection with it, the temperature of the coolant which flows through the thermally-actuated valve 28 also decreases. Therefore, in the range of SPCCI combustion, the thermally-actuated valve 28 gradually closes, and it will become fully closed. Therefore, the coolant which flows into the radiator passage 53 through the connecting passage 52 gradually decreases, and will not flow.

Although in the example of FIG. 7 a proportional relationship exists between the flow rate reduction of the coolant which flows through the bypass passage 51 and the flow rate increase of the coolant which flows through the radiator passage 53, there is no necessity of being the proportional relationship. In the range of SPCCI combustion, the flow rate of the coolant which flows through the coolant control valve 4 may be below the upper limit.

(Range of SI Combustion)

In the range of SI combustion, the adjustment is performed in the coolant control valve 4 so that the temperature of the coolant which flows through the first jacket 22*a* is held at the second target temperature t22. In detail, the actuator 62 is controlled, and the adjustment is made so that the opening between the third port 65 and the second port 64 becomes large, and the opening between the third port 65 and the first port 63 becomes small, as the load of the engine 10 increases. Thus, the coolant which flows through the radiator passage 53 gradually increases, and the coolant which flows through the bypass passage 51 gradually decreases (see G3, G5). By doing so, the temperature of the coolant which flows through the first jacket 22*a* can be held at the second target temperature t22 (see G6).

In the range where SI combustion is performed, it becomes possible to suppress abnormal combustion, such as knocking, by relatively lowering the temperature of the coolant.

In the range of SPCCI combustion (in other words, the range above the first load L1 and below the second load L2), in order to maintain the wall temperature of the combustion chamber 16 constant, the temperature of the coolant which flows through the first jacket 22*a* is positively lowered as the load of the engine 10 increases. Therefore, with respect to the increase in the load of the engine 10, a degree of change in the flow rate of the coolant which flows into the bypass passage 51 from the coolant control valve 4, and a degree of change in the flow rate of the coolant which flows into the radiator passage 53 from the coolant control valve 4 are relatively large. That is, slopes of G3 and G5 are larger.

On the other hand, in the range of SI combustion (in other words, the range above the second load L2), in order to hold the temperature of the coolant at the second target temperature t22, with respect to the increase in the load of the engine 10, a degree of change in the flow rate of the coolant which flows into the bypass passage 51 from the coolant control valve 4, and a degree of change in the flow rate of the coolant which flows into the radiator passage 53 from the coolant control valve 4 are relatively small. That is, the slopes of G3 and G5 are small, and the slopes of G3 and G5 change at the second load L2.

Note that in the range of SI combustion (in other words, the range above the second load L2), the proportional relationship between the flow rate reduction of the coolant which flows through the bypass passage 51 and the flow rate increase of the coolant which flows through the radiator passage 53 is not essential. In the range of SI combustion, the flow rate of the coolant which flows through the coolant control valve 4 may be below the upper limit.

In the range of SI combustion, the flow rate of the coolant which flows through the first jacket 22*a* is the maximum, and the temperature of the coolant is held at the second target temperature t22. Since the heat occurring inside the combustion chamber 16 increases as the load of the engine 10 increases, the wall temperature of the combustion chamber 16 gradually rises as the load of the engine 10 increases (see G8).

Note that in the range of SI combustion, since the temperature of the coolant is maintained at the second target temperature t22, the thermally-actuated valve 28 is fully closed. The coolant does not flow into the connecting passage 52. The bypass passage 51 and the radiator passage 53 constitute mutually independent passages.

Next, a control executed by the ECU 100 for cooling of the engine 10 is described with reference to FIGS. 8 and 9.

Figure 8:
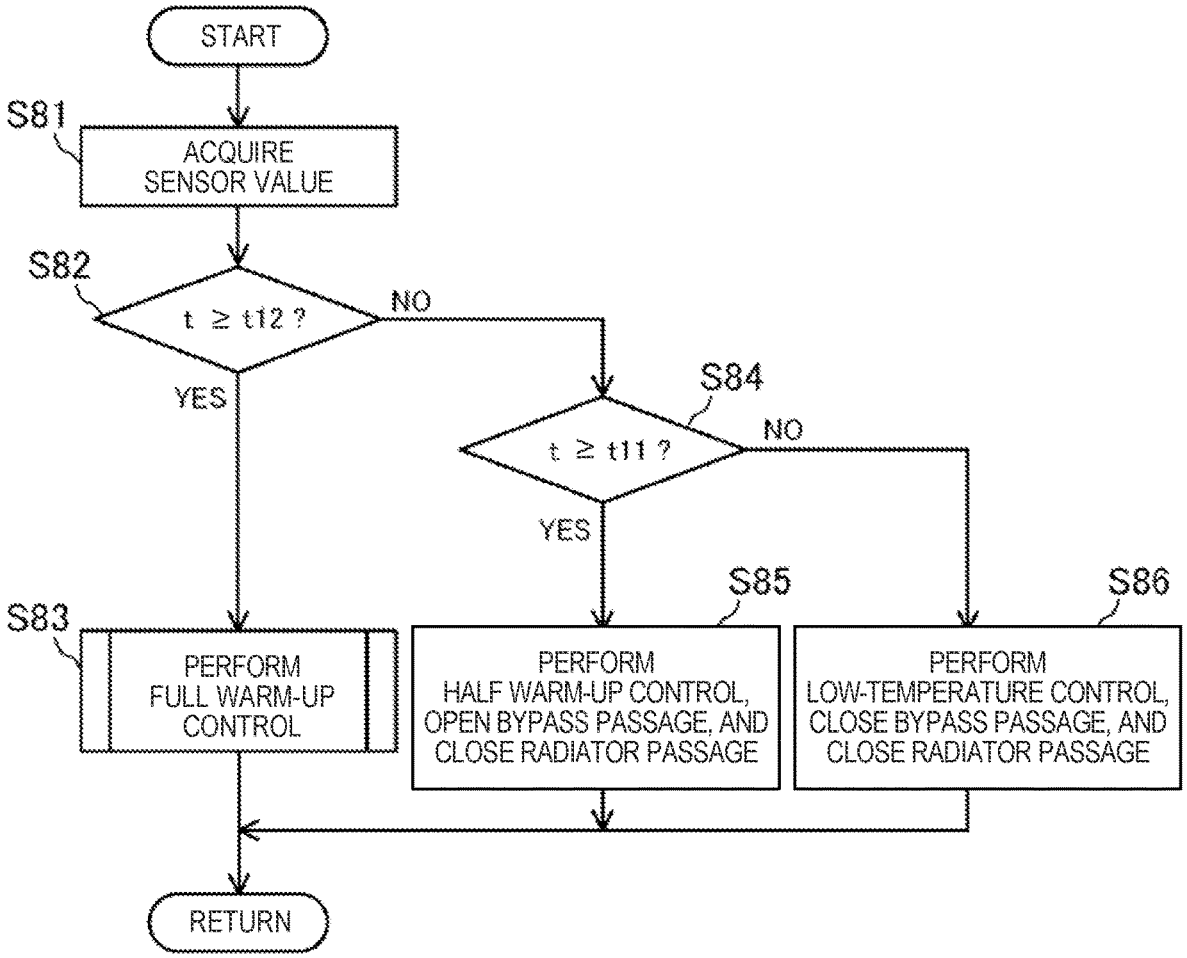
FIG. 8 illustrates an exemplary control procedure of the circulation system.

FIG. 8 is a flowchart for switching between a cold state, a half warmed up state, and a fully warmed up state of the engine 10. First, at Step S81 after the start, the ECU 100 acquires signal values outputted from various kinds of the sensors SN1-SN5. The subsequent Step S82, the ECU 100 determines whether the temperature t of the coolant is at or above the second switching temperature t12 based on the signal from the second water temperature sensor SN2. If the temperature t of the coolant is at or above the second switching temperature t12, the process shifts from Step S82 to Step S83. At Step S83, the ECU 100 executes a full warm-up control. The details of the full warm-up control is described with reference to FIG. 9.

If the temperature of the coolant is below the second switching temperature t12, the process shifts from Step S82 to Step S84. At Step S84, the ECU 100 determines whether the temperature t of the coolant is at or above the first switching temperature t11. If the temperature t of the coolant is at or above the first switching temperature t11, the process shifts from Step S84 to Step S85. At Step S85, the ECU 100 executes a half warm-up control. As described above, the ECU 100 opens the bypass passage 51 and closes the radiator passage 53, through the coolant control valve 4.

If the temperature t of the coolant is below the first switching temperature t11, the process shifts from Step S84 to Step S86. At Step S86, the ECU 100 executes a low-temperature control. As described above, the ECU 100 closes the bypass passage 51 and closes the radiator passage 53, through the coolant control valve 4.

Figure 9:
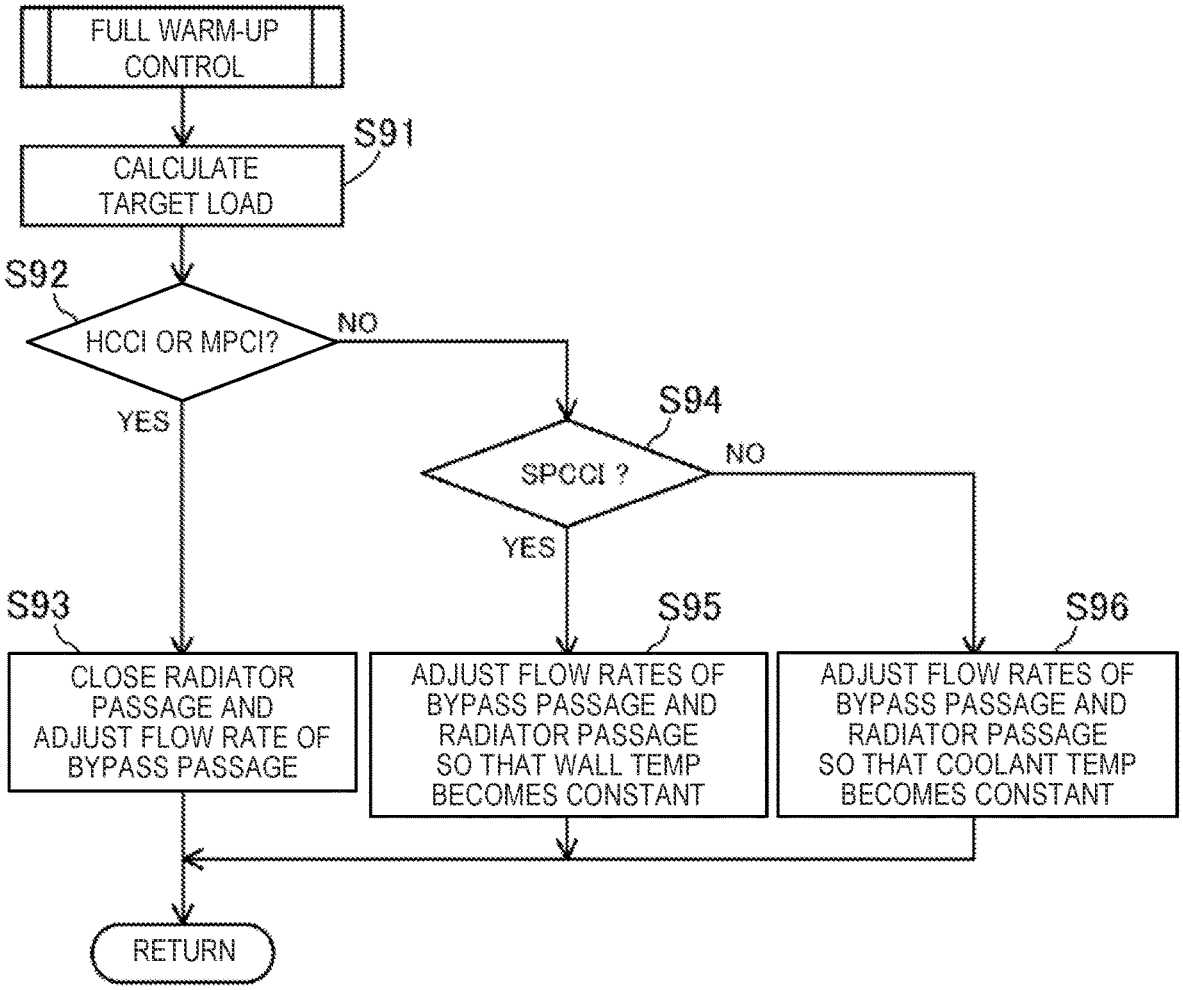
FIG. 9 illustrates an exemplary control procedure of the circulation system.

FIG. 9 illustrates a flow of the full warming-up control at Step S83. At Step S91 after the start, the ECU 100 calculates a target load of the engine 10 based on the signal values outputted from the sensors SN1-SN5. At the subsequent Step S92, the ECU 100 determines whether the combustion mode is HCCI combustion or MPCI combustion based on the target load L. If the determination at Step S92 is YES, the process shifts from Step S92 to Step S93. At Step S93, the ECU 100 executes the flow rate control. That is, the ECU 100 closes the radiator passage 53 and adjusts the flow rate of the bypass passage 51 according to the load of the engine 10, through the coolant control valve 4.

If the combustion modes are not HCCI combustion and MPCI combustion, the process shifts from Step S92 to Step S94. At Step S94, the ECU 100 determines whether the combustion mode is SPCCI combustion based on the target load L. If the determination at Step S94 is YES, the process shifts from Step S94 to Step S95. At Step S95, the ECU 100 executes the temperature control. That is, the ECU 100 adjusts the flow rates of the radiator passage 53 and the bypass passage 51 through the coolant control valve 4 according to the load of the engine 10 so that the wall temperature of the combustion chamber 16 becomes constant.

If the combustion mode is SI combustion, the process shifts from Step S94 to Step S96. At Step S96, the ECU 100 adjusts the flow rates of the radiator passage 53 and the bypass passage 51 through the coolant control valve 4 according to the load of the engine 10 so that the temperature of the coolant becomes constant.

(Modification of Circulation System)

Figure 10:
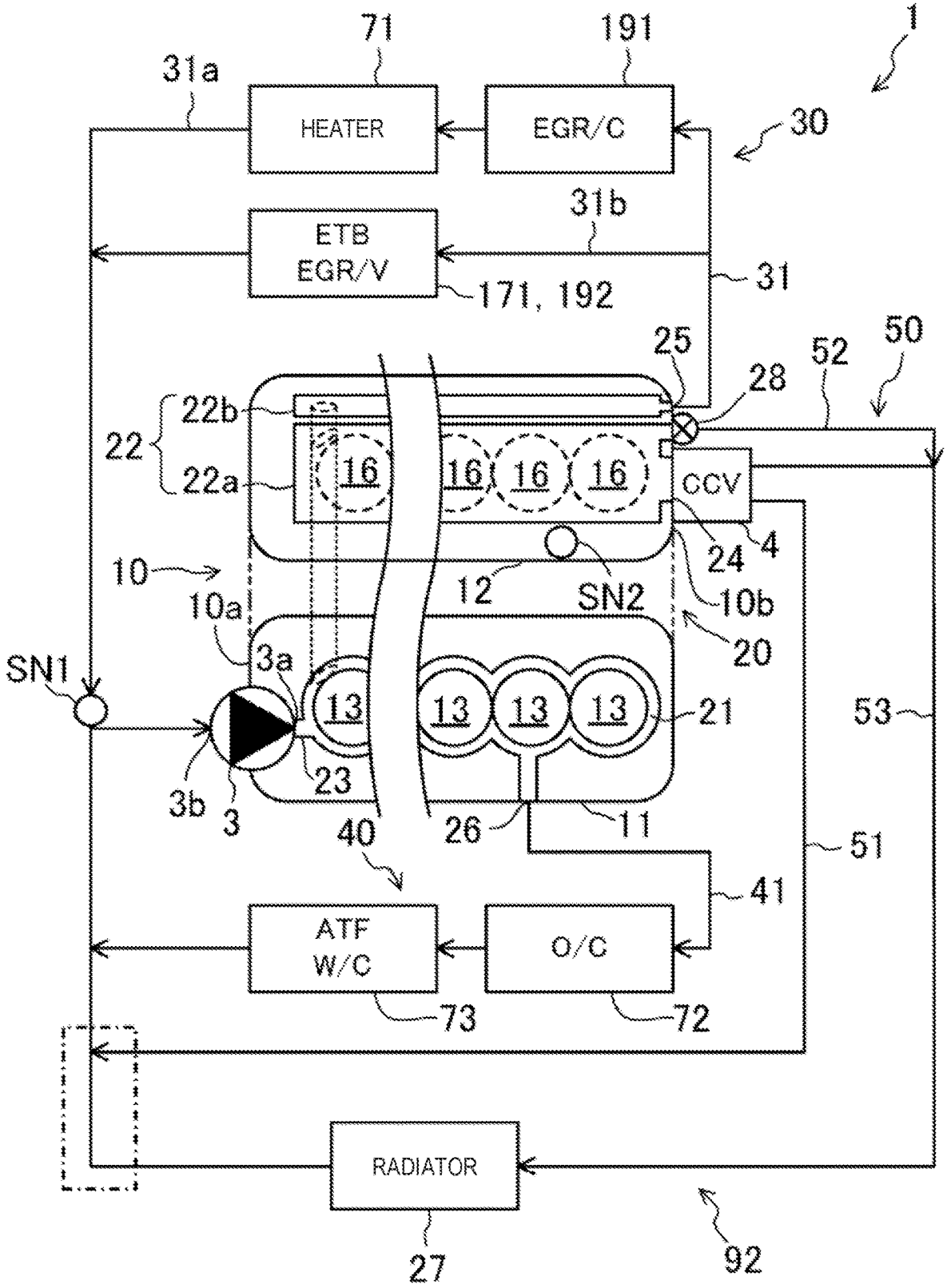
FIG. 10 illustrates an exemplary circulation system.

FIG. 10 illustrates a circulation system 92 according to a modification. This circulation system 92 differs from the circulation system 91 of FIG. 4 in the position of the thermally-actuated valve 28.

In detail, the thermally-actuated valve 28 is attached to the outflow-side end part 10*b* of the engine 10, instead of the bypass passage 51. A downstream end of the first jacket 22*a* provided to the cylinder head 12 branches into two. The coolant control valve 4 and the thermally-actuated valve 28 are connected to the first jacket 22*a*.

The thermally-actuated valve 28 is connected by the radiator passage 53 via the connecting passage 52. In more detail, the connecting passage 52 is connected to a part of the radiator passage 53 upstream of the radiator 27.

Note that this circulation system 92 does not have the connecting passage which connects the bypass passage 51 to the radiator passage 53 in the circulation system 91 of FIG. 4.

How the coolant flows in the circulation system 92 is the same as the circulation system 91 of FIG. 4. That is, if the temperature t of the coolant is in "Low Temperature" state below the first switching temperature t11, the coolant neither flows into the bypass passage 51 nor the radiator passage 53 (both the flow rates are zero). At this time, in the coolant control valve 4, the rotary valve body 61 is set at the rotational position where both the first port 63 and the second port 64 do not communicate with the third port 65.

Further, the thermally-actuated valve 28 is closed. Therefore, in the first circuit 50, the circulation of the coolant is not performed.

If the temperature t of the coolant is in "Half Warm-up" state at or above the first switching temperature t11 and below the second switching temperature t12, although the coolant flows to the bypass passage 51, it does not flow to the radiator passage 53 (the flow rate of the radiator passage 53 is zero). At this time, in the coolant control valve 4, the rotary valve body 61 is set at the rotational position where only the first port 63 communicates with the third port 65. The opening of the first water flow opening 61*a* is fully open, for example. Further, since the temperature of the coolant is low, the thermally-actuated valve 28 is closed. In the first circuit 50, the circulation of the coolant is performed only in the bypass passage 51.

If the temperature t of the coolant is in "Ful Warm-up" state at or above the second switching temperature t12, the circulation system 92 is controlled according to the change of the combustion mode.

Concretely, when the operating state of the engine 10 is in the range of HCCI combustion or MPCI combustion, the flow rate control is performed. The temperature of the coolant is kept constant by the thermally-actuated valve 28. The coolant control valve 4 opens the bypass passage 51 and closes the radiator passage 53. Note that the coolant may pass through the radiator 27 by the thermally-actuated valve 28 being opened. The coolant control valve 4 adjusts the flow rate of the coolant which flows through the bypass passage 51 according to the load of the engine 10. Therefore, the wall temperature of the combustion chamber 16 is maintained at the target temperature tw.

The temperature control is performed when the operating state of the engine 10 is in the range of SPCCI combustion and below the second load L2. The coolant control valve 4 opens both the bypass passage 51 and the radiator passage 53. In more detail, the coolant control valve 4 reduces the flow rate of the coolant which flows through the bypass passage 51 and increases the flow rate of the coolant which flows through the radiator passage 53, as the load of the engine 10 increases. Therefore, the wall temperature of the combustion chamber 16 is maintained at the target temperature tw.

When the operating state of the engine 10 is in the range of SI combustion, the coolant control valve 4 adjusts the flow rates of the coolant which flows through the bypass passage 51 and the radiator passage 53 so that the temperature t of the coolant becomes constant at the second target temperature t22. In more detail, the coolant control valve 4 reduces the flow rate of the coolant which flows through the bypass passage 51 and increases the flow rate of the coolant which flows through the radiator passage 53, as the load of the engine 10 increases. The thermally-actuated valve 28 is closed.

Since the engine system 1 provided with the circulation system 92 performs the flow rate control in the range of HCCI combustion or MPCI combustion, it can change the flow rate of the coolant which flows through the first jacket 22*a* with high response to the load of the engine 10 changing, and can keep the wall temperature of the combustion chamber 16 constant.

Further, since the wall temperature of the combustion chamber 16 can be maintained at the target temperature tw by performing the temperature control in the range of SPCCI combustion, even if the combustion mode of the engine 10 is switched between HCCI combustion, MPCI combustion, and SPCCI combustion, the wall temperature of the combustion chamber 16 does not change. The HCCI combustion and MPCI combustion without forcible ignition can be performed stably, and the SPCCI combustion accompanied by forcible ignition can also be performed stably.

The circulation system 92 does not provide the thermally-actuated valve 28 to downstream of the coolant control valve 4. The connecting passage 52 is a passage which bypasses the coolant control valve 4. For this reason, even if the coolant control valve 4 has failed, such as valve adhesion, the thermally-actuated valve 28 can be opened to cool the coolant by the radiator 27 when the temperature of the coolant reaches the valve-opening temperature of the thermally-actuated valve 28. Since the circulation system 92 can suppress that the temperature of the coolant becomes excessively high, it is advantageous to improve the reliability of the engine system 1.

Other Embodiments

Note that in the circulation system 91 of FIG. 4, the position of the coolant control valve 4 may be changed. In detail, the coolant control valve 4 may be provided at a location where the bypass passage 51 and the radiator passage 53 join (a location surrounded by a one-dot chain line of FIG. 4). In this configuration, the upstream end of the bypass passage 51 and the upstream end of the radiator passage 53 are connected mutually-independently to the first jacket 22*a*. Further, the connecting passage 52 may connect the bypass passage 51 to a location of the radiator passage 53 downstream of the radiator 27, and the thermally-actuated valve 28 may be provided so as to open and close the connecting passage 52.

Similarly, in the circulation system 92 of FIG. 10, the position of the coolant control valve 4 may be changed. In detail, the coolant control valve 4 may be provided at a location where the bypass passage 51 and the radiator passage 53 join (a location surrounded by a one-dot chain line of FIG. 10). In this configuration, the upstream end of the bypass passage 51 and the upstream end of the radiator passage 53 are connected mutually-independently to the first jacket 22*a*. Further, the connecting passage 52 may connect a part of the radiator passage 53 downstream of the radiator 27 and a part upstream of the water pump 3 so as to bypass the coolant control valve 4, and the thermally-actuated valve 28 may be provided so as to open and close the connecting passage 52.

Further, the flow rate control device is not limited to be comprised of the coolant control valve 4 having the rotary valve body 61. The flow rate control device may be comprised of a first flow rate control valve which adjusts the flow rate of the coolant which flows through the bypass passage 51, and a second flow rate control valve which adjusts the flow rate of the coolant which flows through the radiator passage 53 and is independent from the first flow rate control valve.

FIG. 3 illustrates one example of the control of the engine system 1. The switching of the combustion mode is not limited to the example of FIG. 3.

It should be understood that the embodiments herein are illustrative and not restrictive, since the scope of the invention is defined by the appended claims rather than by the description preceding them, and all changes that fall within metes and bounds of the claims, or equivalence of such metes and bounds thereof, are therefore intended to be embraced by the claims.

DESCRIPTION OF REFERENCE CHARACTERS

1 Engine System
10 Engine

16 Combustion Chamber
100 ECU (Controller)
132 Spark Plug
22*a* First Jacket (Water Jacket)
27 Radiator (Heat Exchanger)
28 Thermally-actuated Valve
4 Coolant Control Valve (Flow Rate Control Device)
51 Bypass Passage
52 Connecting Passage
53 Radiator Passage
91 Circulation System
92 Circulation System

What is claimed is:

1. An engine system, comprising:

an engine having a water jacket formed around a combustion chamber;

a circulation system that is attached to the engine and circulates coolant through the water jacket; and a controller configured to control the circulation system according to an operating state of the engine, wherein the circulation system includes:

a radiator passage including a heat exchanger;

a bypass passage bypassing the heat exchanger;

a coolant control valve that adjusts a flow rate of coolant flowing through the water jacket by adjusting a flow rate of coolant flowing through each of the radiator passage and the bypass passage; and a thermally-actuated valve that is connected to the radiator passage and opens to allow the coolant to pass through the heat exchanger, wherein the engine has a spark plug that forcibly ignites an air-fuel mixture, wherein the engine switches between a first combustion in which the air-fuel mixture combusts without the forcible ignition of the spark plug, and a second combustion in which the air-fuel mixture combusts by the forcible ignition of the spark plug, wherein the controller is electrically connected to the coolant control valve, and wherein when the engine performs the first combustion, the controller controls the coolant control valve to adjust the flow rate of the coolant flowing through the water jacket according to a load of the engine, by closing the radiator passage and adjusting the flow rate of the coolant flowing through the bypass passage.

2. The engine system of claim 1, wherein when the engine performs the first combustion, the controller increases the flow rate of the coolant flowing through the water jacket as the load increases.

3. The engine system of claim 1, wherein when the engine performs the second combustion, the controller controls the coolant control valve to allow the coolant to flow through each of the radiator passage and the bypass passage.

4. The engine system of claim 2, wherein when the engine performs the second combustion, the controller controls the coolant control valve to allow the coolant to flow through each of the radiator passage and the bypass passage.

5. The engine system of claim 3, wherein when the engine performs the second combustion, the controller adjusts a temperature of the coolant flowing through the water jacket according to the load by adjusting the flow rate of the coolant flowing through the bypass passage and the flow rate of the coolant flowing through the radiator passage.

6. The engine system of claim 4, wherein when the engine performs the second combustion, the controller adjusts a temperature of the coolant flowing through the water jacket according to the load by adjusting the flow rate of the coolant flowing through the bypass passage and the flow rate of the coolant flowing through the radiator passage.

7. The engine system of claim 5, wherein when the engine performs the second combustion, the controller reduces the flow rate of the coolant flowing through the bypass passage and increases the flow rate of the coolant flowing through the radiator passage, as the load increases.

8. The engine system of claim 6, wherein when the engine performs the second combustion, the controller reduces the flow rate of the coolant flowing through the bypass passage and increases the flow rate of the coolant flowing through the radiator passage, as the load increases.

9. The engine system of claim 1, wherein when the engine performs the second combustion, the controller sets the flow rate of the coolant flowing through the water jacket at a maximum flow rate.

10. The engine system of claim 8, wherein when the engine performs the second combustion, the controller sets the flow rate of the coolant flowing through the water jacket at a maximum flow rate.

11. The engine system of claim 1, wherein both when the engine performs the first combustion and when the engine performs the second combustion, the controller controls the coolant control valve to adjust the flow rate of the coolant flowing through the water jacket and the bypass passage such that a wall temperature of the combustion chamber is maintained at a constant temperature.

12. The engine system of claim 8, wherein both when the engine performs the first combustion and when the engine performs the second combustion, the controller controls the coolant control valve to adjust the flow rate of the coolant flowing through the water jacket and the bypass passage such that a wall temperature of the combustion chamber is maintained at a constant temperature.

13. The engine system of claim 11, wherein when the engine performs the second combustion, the controller lowers the temperature of the coolant flowing through the water jacket below a valve-opening temperature of the thermally-actuated valve.

14. The engine system of claim 7, wherein in a case where the engine performs the second combustion, when the load is below a given load, the controller increases the flow rate of the coolant flowing through the radiator passage to lower the temperature of the coolant flowing through the water jacket as the load increases and, when the load is above the given load, the controller increases the flow rate of the coolant flowing through the radiator passage to maintain the temperature of the coolant flowing through the water jacket constant with respect to the load increase.

15. The engine system of claim 1, wherein the controller determines a combustion mode of the engine at least based on an accelerator opening detected, and controls the circulation system according to the determined combustion mode.

16. The engine system of claim 1, wherein the coolant control valve is installed at a location branching into the bypass passage and the radiator passage, or a location where the bypass passage and the radiator passage are joined, wherein the circulation system further includes a connecting passage connecting the bypass passage to the radiator passage, and wherein the thermally-actuated valve opens and closes the connecting passage.

17. The engine system of claim 1, wherein the coolant control valve is installed at a location branching into the bypass passage and the radiator passage, or a location where the bypass passage and the radiator passage are joined, wherein the circulation system further includes a connecting passage bypassing the coolant control valve and connecting the water jacket to the radiator passage, and wherein the thermally-actuated valve opens and closes the connecting passage.

18. The engine system of claim 14, wherein the controller determines a combustion mode of the engine at least based on an accelerator opening detected, and controls the circulation system according to the determined combustion mode.

19. The engine system of claim 15, wherein the coolant control valve is installed at a location branching into the bypass passage and the radiator passage, or a location where the bypass passage and the radiator passage are joined, wherein the circulation system further includes a connecting passage connecting the bypass passage to the radiator passage, and wherein the thermally-actuated valve opens and closes the connecting passage.

20. The engine system of claim 15, wherein the coolant control valve is installed at a location branching into the bypass passage and the radiator passage, or a location where the bypass passage and the radiator passage are joined, wherein the circulation system further includes a connecting passage bypassing the coolant control valve and connecting the water jacket to the radiator passage, and wherein the thermally-actuated valve opens and closes the connecting passage.

* * * * *